US011738355B2

(12) United States Patent
Hasday et al.

(10) Patent No.: US 11,738,355 B2
(45) Date of Patent: Aug. 29, 2023

(54) FLAG MUSHROOM CUP NOZZLE ASSEMBLY AND METHOD

(71) Applicant: DLHBOWLES, INC., Canton, OH (US)

(72) Inventors: Benjamin D. Hasday, Baltimore, MD (US); Evan Hartranft, Bowie, MD (US)

(73) Assignee: DLHBOWLES, INC., Canton, OH (US)

( * ) Notice: Subject to any disclaimer, the term of this patent is extended or adjusted under 35 U.S.C. 154(b) by 151 days.

(21) Appl. No.: 17/328,381

(22) Filed: May 24, 2021

(65) Prior Publication Data

US 2021/0291204 A1 Sep. 23, 2021

Related U.S. Application Data

(63) Continuation of application No. 16/097,985, filed as application No. PCT/US2017/030858 on May 3, 2017, now Pat. No. 11,014,099.

(Continued)

(51) Int. Cl.

| | |
|---|---|
| ***B05B 1/08*** | (2006.01) |
| ***B05B 1/34*** | (2006.01) |
| ***B05B 12/06*** | (2006.01) |

(52) U.S. Cl.

CPC ..... *B05B 1/08* (2013.01); *B05B 1/34* (2013.01); *B05B 12/06* (2013.01)

(58) Field of Classification Search

CPC ..... B05B 1/34; B05B 1/3442; B05B 1/341; B05B 1/3436; B05B 1/06; B05B 1/08; B05B 1/02

See application file for complete search history.

(56) References Cited

U.S. PATENT DOCUMENTS

| | | | |
|---|---|---|---|
| 4,036,439 | A | 7/1977 | Green |
| 4,187,985 | A | 2/1980 | Goth |

(Continued)

FOREIGN PATENT DOCUMENTS

| | | |
|---|---|---|
| WO | 2012145537 | 10/2012 |
| WO | WO2016/025858 | 2/2016 |

OTHER PUBLICATIONS

Patent Cooperation Treaty (PCT), International Search Report and Written Opinion for Application PCT/US2017/030858 filed May 3, 2017, dated Sep. 29, 2017, International Searching Authority, US.

*Primary Examiner* — Tuongminh N Pham

(74) *Attorney, Agent, or Firm* — McDonald Hopkins LLC

(57) ABSTRACT

An alignable conformal, cup-shaped flag-mushroom fluidic nozzle assembly is engineered to generate a flat fan or sheet oscillating spray of viscous fluid product 316. The nozzle assembly includes a cylindrical flag mushroom fluidic cup member 180 having a substantially closed distal end wall with a centrally located snout defined therein. The flag mushroom cup assembly effectively splits the operating features of the fluidic circuit between a lower or proximal portion formed in the housing's sealing post member and an upper, or distal portion formed in cup member 180 which, in cooperation with the sealing post's distal surface, defines an interaction chamber 192 fed by impinging jets each comprising a continuous distribution of streamlines that impinge at selected angles to define arcs providing a lesser degree of impingement at a centered axial plane within the exit orifice 194 and a greater degree of impingement at the edges of exit orifice 194.

12 Claims, 16 Drawing Sheets

Related U.S. Application Data

(60) Provisional application No. 62/331,065, filed on May 3, 2016.

(56) References Cited

U.S. PATENT DOCUMENTS

| | | | | |
|---|---|---|---|---|
| 5,114,052 | A | 5/1992 | Tiramani et al. | |
| 5,639,025 | A | 6/1997 | Bush | |
| 5,769,325 | A | 6/1998 | Jouillat | |
| 6,543,703 | B2 | 4/2003 | Blake | |
| 6,793,156 | B2 | 9/2004 | Dobbs et al. | |
| 7,267,290 | B2 | 9/2007 | Gopalan et al. | |
| 7,926,741 | B2 | 4/2011 | Laidler et al. | |
| 9,089,856 | B2 | 7/2015 | Gopalan et al. | |
| 9,821,324 | B2 | 11/2017 | Hartranft | |
| 2001/0011687 | A1 | 8/2001 | Benoist | |
| 2009/0078793 | A1 | 3/2009 | Nelson et al. | |
| 2012/0193455 | A1 | 8/2012 | Morgan et al. | |
| 2014/0263742 | A1 | 9/2014 | Gopalan et al. | |
| 2014/0291423 | A1 | 10/2014 | Gopalan et al. | |
| 2017/0252758 | A1* | 9/2017 | Lin | B05B 1/048 |

* cited by examiner

FLAG MUSHROOM CUP NOZZLE ASSEMBLY AND METHOD

CROSS-REFERENCE TO RELATED APPLICATIONS

This application is a continuation of U.S. application Ser. No. 16/097,985 entitled, "Flag Mushroom Cup Nozzle Assembly and Method," filed on Oct. 31, 2018, which a U.S. national phase entry of International Patent Application No. PCT/US2017/030858 filed on May 3, 2017, which claims priority to commonly owned U.S. provisional patent application No. 62/331,065, filed 3 May 2016, the entire disclosure of which is hereby incorporated herein by reference. This application is also related to commonly owned U.S. provisional patent application No. 61/476,845, filed Apr. 19, 2011 and entitled "Method and Fluidic Cup Apparatus for Creating 2-D or 3-D Spray Patterns", as well as PCT application number PCT/US12/34293, filed Apr. 19, 2012 and entitled "Cup-shaped Fluidic Circuit, Nozzle Assembly and Method" (now WIPO Pub WO 2012/145537), U.S. application Ser. No. 13/816,661, filed Feb. 12, 2013, and commonly owned U.S. Pat. No. 9,089,856, the entire disclosures of which are also hereby incorporated herein by reference.

FIELD OF THE INVENTION

The present invention relates generally to nozzle assemblies adapted for use with transportable or disposable liquid product sprayers, and more particularly to such sprayers having nozzle assemblies configured for dispensing or generating sprays of selected fluids or liquid products in a desired spray pattern.

DISCUSSION OF THE PRIOR ART

Cleaning fluids, hair spray, skin care products and other liquid products are often dispensed from disposable, pressurized or manually actuated sprayers which can generate a roughly conical spray pattern or a straight stream. Some dispensers or sprayers have an orifice cup with a discharge orifice through which product is dispensed or applied by sprayer actuation. For example, the manually actuated sprayer of U.S. Pat. No. 6,793,156 to Dobbs, et al illustrates an improved orifice cup mounted within a discharge passage of a manually actuated hand-held sprayer. The cup has a cylindrical side wall, or skirt which is press fitted within a cylindrical wall of a circular bore that is part of the discharge passage in the sprayer assembly to hold the cup in place. Dobbs' orifice cup includes "spin mechanics" in the form of a spin chamber in which spinning or tangential flows are formed on the inner surface of a circular base wall of the orifice cup. Upon manual actuation of the sprayer, fluid pressures are developed as the liquid product is forced through a constricted discharge passage and through the spin mechanics before issuing through the discharge orifice in the form of a traditional conical spray. If no spin mechanics are provided or if the spin mechanics feature is immobilized, the liquid issues from the discharge orifice in the form of a stream.

Typical orifice cups are molded with an annular retention bead that projects radially outwardly of the cylindrical skirt wall near the front or distal end of the cup to provide a tight frictional engagement between the cylindrical side wall of the cup and the cylindrical bore wall. The annular retention bead is designed to project into the confronting cylindrical bore of the pump sprayer body and serves to assist in retaining the orifice cup in place within the bore as well as in acting as a seal between the orifice cup and the bore of the discharge passage. The spin mechanics feature is formed on the inner surface of the base of the orifice cup to provide a swirl cup which functions to swirl the fluid or liquid product and break it up into a substantially conical spray pattern.

Manually pumped trigger sprayer of U.S. Pat. No. 5,114,052 to Tiramani, et al illustrates a trigger sprayer having a molded spray cap nozzle with radial slots or grooves which swirl the pressurized liquid to generate an atomized spray from the nozzle's orifice. Other spray heads or nebulizing nozzles used in connection with disposable, manually actuated sprayers are incorporated into propellant pressurized packages including aerosol dispensers such as those described in U.S. Pat. No. 4,036,439 to Green and U.S. Pat. No. 7,926,741 to Laidler et al. All of these spray heads or nozzle assemblies include a swirl system or swirl chamber which work with a dispensing orifice through which the fluid is discharged from the dispenser member. The recesses, grooves or channels defining the swirl system co-operate with the nozzle to entrain the dispensed liquid or fluid in a swirling movement before it is discharged through the dispensing orifice. The swirl system is conventionally made up of one or more tangential swirl grooves, troughs, passages or channels opening out into a swirl chamber accurately centered on the dispensing orifice. The swirled, pressurized fluid is discharged through the dispensing orifice. U.S. Pat. No. 4,036,439 to Green describes a cup-shaped insert with a discharge orifice which fits over a projection having the grooves defined in the projection, so that the swirl cavity is defined between the projection and the cup-shaped insert.

These prior art nozzle assembly or spray-head structures with swirl chambers are configured to generate substantially conical atomized or nebulized sprays of fluid or liquid in a continuous flow over the entire spray pattern; however, in such devices the spray droplet sizes are poorly controlled, often generating "fines" or nearly atomized droplets as well as larger droplets. Other spray patterns such as, for example, a narrow oval which is nearly linear, are possible, but the control over the spray's pattern is limited. None of these prior art swirl chamber nozzles can generate an oscillating sheet spray of liquid nor can they provide precise sprayed droplet size control or sheet spray pattern control. There are several consumer products packaged in aerosol sprayers and trigger sprayers where it is desirable to provide customized, precise liquid sheet spray patterns for products such as paints, oils and lotions.

Oscillating fluidic sprays have many advantages over conventional, continuous sprays, and fluidic spray devices can be configured to generate an oscillating spray of liquid which will provide a precise sprayed droplet size control and a precisely customized spray pattern for a selected liquid or fluid. The Applicants have been approached by liquid product makers who want to provide those advantages, but available prior art fluidic nozzle assemblies have not been configured for incorporation with disposable, manually actuated sprayers. Meeting such needs has led to Applicants' related applications and patents incorporating fluidic circuits in Cup-shaped members, such as WIPO Pub WO 2012/145537 and U.S. Pat. No. 9,089,856 (which includes illustrations corresponding to FIGS. 1A-1F, provided here for enablement and to illustrate the configurations and nomenclature of applicants' prior work), but these nozzle configurations are not well suited to generating flat sprays of highly viscous fluids such as paint or lotion.

In Applicants' durable and precise prior art fluidic circuit nozzle configurations, a fluidic nozzle is constructed by assembling a planar fluidic circuit or insert into a weatherproof housing having a cavity that receives and aims the fluidic insert and seals the flow passage. A good example of a fluidic oscillator equipped nozzle assembly as used in the automotive industry is illustrated in commonly owned U.S. Pat. No. 7,267,290 which shows how a planar fluidic circuit insert is received within and aimed by a housing.

More specialized fluidic circuit generated sprays for highly viscous fluids could be very useful in disposable sprayers, but adapting the fluidic circuits and fluidic circuit nozzle assemblies of the prior art would cause additional engineering and manufacturing process changes to the currently available disposable, manually actuated sprayers, thus making them too expensive to produce at a commercially reasonable cost, especially when the sprayers are intended for single-use spraying.

There is a need, therefore, for a disposable, manually actuated sprayer or nozzle assembly that can be produced at a commercially reasonable cost, and which provides the advantages of fluidic circuits and oscillating sprays, including precise sprayed droplet size control and precisely defined sprays (e.g., flat fan shaped patterns) for viscous, shear-thinning liquids or fluid products.

OBJECTS AND SUMMARY OF THE INVENTION

Accordingly, it is an object of the present invention to overcome the above-mentioned difficulties by providing a commercially reasonably inexpensive, disposable, manually actuated, cup-shaped nozzle assembly adapted for use with a flag-mushroom fluidic circuit to provide precise sprayed droplet size control and precisely defined spray sheets or flat fan shaped spray patterns when spraying viscous, shear-thinning liquids or fluid products.

The flag mushroom cup nozzle assembly of the present invention is configured as a cup and housing package somewhat similar to that illustrated in the prior art of FIGS. 1A-1C, but incorporates a nozzle assembly in an actuator body having a fluidic circuit configured to spray an oscillating sheet of fluid product droplets distally from a sprayer housing instead of the conical spray with a circular cross-section produced by the FIGS. 1A-1C device. This configuration, which can be adapted to provide multi-lip and multi-power nozzle embodiments, generates a spray of shear thinning and high viscosity fluids with even distribution. The packaging concept and method of the present invention allow easier molding of small fluidic circuits because the circuit features are defined or "shared" between two larger molded pieces rather than having all of the fluidic circuit features defined in one molded piece.

The nozzle assembly and cup member of the present invention differs from Applicants' prior work (as illustrated in FIG. 1D), in that the invention incorporates a distinctive housing and sealing package, as well as a distinctive fluidic circuit geometry molded into the cup member. Thus, the flag mushroom cup assembly of the present invention effectively splits the operating features of the fluidic circuit between a lower or proximal portion formed in the housing's sealing post member and an upper, or distal portion formed in the cup member. The assembly of the present invention is made possible by configuring the packaging and design of a flag mushroom fluidic circuit to provide a conformal cup-shaped member that ideally is well suited for use with a novel sealing post member, where the new combination is then adapted for integration with commercial spray nozzle assembly components like those described in the prior art and illustrated in FIGS. 1A-1F.

Broadly speaking, the flag mushroom cup nozzle assembly of the present invention includes a cup member having a feed channel with one or more lips at the exit for controlling distribution of the sprayed fluid. The cup member is placed with a pre-defined angular orientation into a sprayer housing over a cooperating sealing post member configured in the middle of a nozzle assembly fluid feed pathway. The combination of the flag mushroom cup and cooperating post member, when assembled, define a desired fluidic circuit oscillator geometry. When spraying, supplied fluid or liquid product flows through first and second power nozzles or channels defined between the post and the cup and the flows from the first and second channels intersect within a distally extending interaction region defined around a distally projecting small protuberance carried on the end of the sealing post. The design of the exit ends of the power nozzles may incorporate a compound curve geometry that can be variously configured to allow for more or less air entrainment in the flowing fluid by changing the geometry of selected features including the throat/PN ratio, to vary the power nozzle exit angle, and to vary the location of the intersection of the first and second streams in the interaction region.

The flag mushroom cup includes a protruding boss or snout to avoid attachment of the spray (by Coanda effect) on the exterior surfaces which define the face of the nozzle; the snout has rounded edges to ensure that the spray does not attach.

In an exemplary commercial product spraying embodiment, the nozzle assembly housing or spray head includes an actuator body or housing having a lumen or duct forming a passageway to a bore. A mushroom cup nozzle is mounted in the bore for dispensing a pressurized liquid product or fluid from a valve, pump or actuator assembly which draws fluid from a disposable or transportable container (e.g., like container 26 in FIG. 1A) to generate an oscillating spray of very uniform fluid droplets. The nozzle assembly actuator body includes a distally projecting sealing post within and spaced from the walls of the bore, the post having a peripheral wall terminating at a distal or outer face in which is defines first and second radial power nozzle channel components of a fluidic circuit. The channels intersect at a central point on the sealing post which corresponds to a central axis or spray axis. At the central point where the first and second power nozzle channels intersect, the channels each have a selected cross sectional area defined by a channel depth and a channel width. The sealing post's distal face also carries at the central point a distally and axially projecting cylindrical protuberance which projects distally along the central axis and has an external diameter which is equal to the width of the channels on the distal face of the sealing post.

The cup-shaped flag-mushroom fluidic circuit defining cup member is mounted in the actuator body housing on the cooperating sealing post at a selected angular orientation about the central axis of the post and is constrained there by an indexing key defined in the sealing post sidewall which is received snugly in a cooperating indexing slot defined in the flag mushroom cup. The nozzle assembly body member or housing bore has a peripheral side wall that is spaced radially outwardly of the cooperating sealing post to form a cylindrical fluid supply lumen sidewall which is sized to snugly receive and support the cylindrical outer wall of the cup member. The bottom of the bore has a radial wall comprising an inner face which defines the bottom of the fluid supply lumen. This radial wall forms a stepped annular surface which is substantially perpendicular to the central axis to provide a plenum volume which is in fluid communication with fluid feed channels in the cup member.

The fluid supply lumen enables fluid product to flow from a container and into fluidic geometry defined between the flag mushroom cup member and the cooperating sealing post, which together define a chamber having an interaction region between the sealing post and the peripheral wall and distal walls of the cup-shaped member. The chamber is in fluid communication with the actuator body fluid passage to define a fluidic circuit oscillator inlet so the pressurized fluid can enter the chamber and interaction region. The flag mushroom cup structure has for example, first and second fluid inlet passageways of substantially constant cross section within the proximally projecting cylindrical sidewall of the cup member; however, these exemplary first and second fluid inlets can alternatively be tapered or include step discontinuities (e.g., with an abruptly smaller or stepped inside diameter) to enhance pressurized fluid instability.

The cup-shaped fluidic circuit distal wall's inner face carries an upper component or distal part of the flag mushroom fluidic geometry, and is configured to define this part of the fluidic oscillator operating features or geometry within the chamber defined between the cup member and the sealing post. It should be emphasized that any fluidic oscillator geometry which defines an interaction region to generate an oscillating spray of fluid droplets can be used, but, for purposes of illustration, conformal cup-shaped flag mushroom fluidic oscillators having an exemplary fluidic oscillator geometry will be described in detail.

For a flag mushroom cup-shaped fluidic oscillator embodiment which cooperates with the cooperating indexed sealing post of the present invention, the cup and post, when assembled, define a chamber including a first power nozzle and second power nozzle, where the first power nozzle is configured to accelerate the movement of passing pressurized fluid flowing to form a first jet of fluid flowing into the chamber's interaction region, and the second power nozzle is configured to accelerate the movement of passing pressurized fluid to form a second jet of fluid flowing into the chamber's interaction region. The first and second jets impinge upon the axial protuberance and are deflected distally to the interaction region, where they impinge on each other at a selected inter-jet impingement angle (e.g., in the range of 50 to 180 degrees to generate oscillating flow vortices within the fluid channel's interaction region which is in fluid communication with a discharge orifice or exit orifice defined in the fluidic circuit's distal wall. The oscillating flow vortices eject spray droplets through the discharge orifice as an oscillating spray of substantially uniform fluid droplets in a selected (e.g., flat fan shaped) spray pattern having a selected spray width and a selected spray thickness.

The first and second power nozzles preferably incorporate Venturi-shaped or tapered channels or grooves formed in the sealing post distal end wall surface, which sealingly abuts the cup-shaped member's distal wall inner face, in which is defined a rectangular or box-shaped interaction region.

The cup member's interaction region and exit orifice or throat are preferably molded directly into the cup's interior wall segments. When molded from plastic as a cup-shaped member, the flag mushroom cup is easily and economically fitted onto the actuator's cooperating indexed sealing post, which typically has a distal or outer face that is in sealing engagement with the cup-shaped member's distal wall's inner face in a substantially fluid impermeable contact. The peripheral walls of the sealing post and the cup-shaped member are spaced radially to define an annular fluid channel around the post. The peripheral walls are generally parallel with each other but the space between them may be tapered to aid in developing greater fluid velocity and instability. Whatever the configuration, when the cup-shaped member is fitted to the indexed sealing post and pressurized fluid is introduced, (e.g., by pressing the aerosol spray button and releasing the propellant), the pressurized fluid enters the fluid channel chamber and interaction region and generates at least one oscillating flow vortex within the fluid channel interaction region.

The flag mushroom cup nozzle assembly of the present invention is configured to spray shear thinning liquids with an even distribution of small droplets. The nozzle assembly is adapted for commercial aerosol sprays like paints, oils, and lotions, and in use generates an even flat fan spray with more uniform and smaller droplets than similar prior art nozzles can generate. The flag mushroom cup nozzle assembly of the present invention, when spraying, does not create voids or hotspots, and also allows for the use of aeration.

The nozzle assembly of the present invention is configured to reliably begin oscillation and then generate droplets of a selected size which are projected distally to provide a precisely defined sheet or flat fan-shaped spray when spraying relatively thick or viscous fluids, such as shear-thinning fluids like Acrylic spray paint. The nozzle assembly is also optimized to generate precise sprays of other thick or viscous liquids such as Lotion, Oil or Chemical cleaners.

The above and still further objects, features and advantages of the present invention will become apparent upon consideration of the following detailed description of specific embodiments, particularly when taken in conjunction with the accompanying drawings, wherein like reference numerals in the various figures are utilized to designate like components.

DESCRIPTION OF THE PREFERRED EMBODIMENT

Figure 1A:
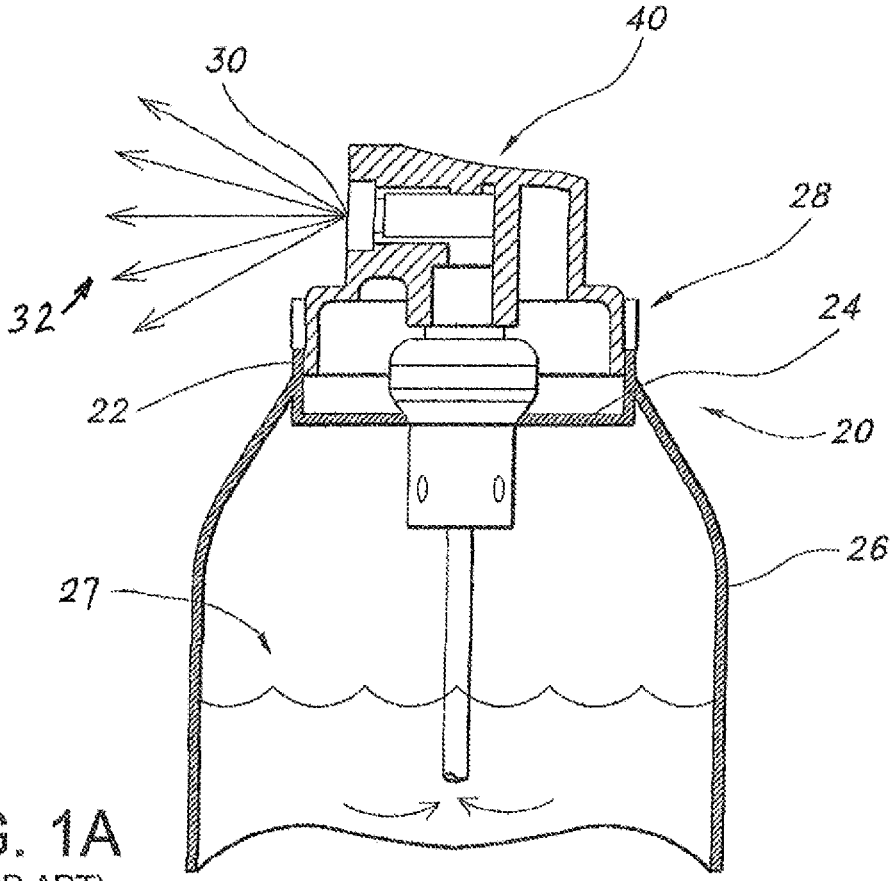
FIG. 1A (PRIOR ART)
FIG. 1A is a cross sectional view in elevation of an aerosol sprayer with a typical valve actuator and swirl cup nozzle assembly, in accordance with the Prior Art.
Figure 1B:
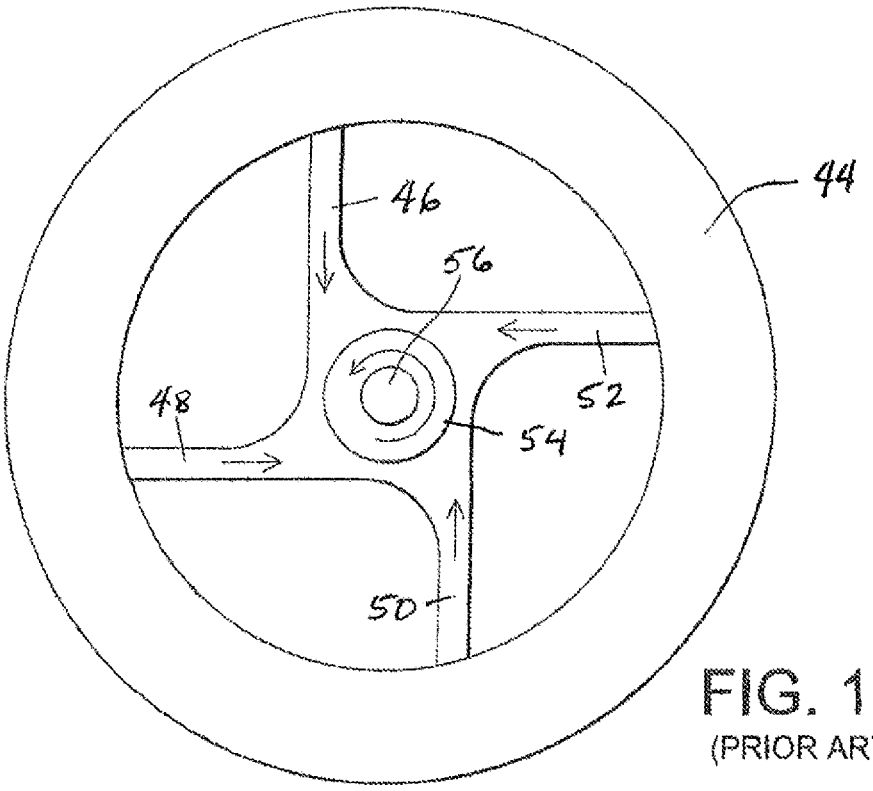
FIG. 1B (PRIOR ART)
FIG. 1B is a plan view of the interior of a standard swirl cup as used with aerosol sprayers and trigger sprayers, in accordance with the Prior Art.

To provide background for the present invention, reference is first made to FIGS. 1A-1F show typical features of aerosol spray actuators and swirl cup nozzles used in the prior art, and these figures are described here to provide added context for the novel features of the invention. Referring specifically to FIG. 1A, a transportable, disposable propellant pressurized aerosol package 20 has a container 26 enclosing a liquid product 27 under pressure and an actuator 40 which controls a valve 42 mounted within a valve cup 24 which is affixed within a neck 28 of the container and supported by container flange 22. In operation, the actuator 40 is depressed to open the valve to allow pressurized liquid to flow through a swirl-cup equipped nozzle 30, thereby producing an aerosol spray 32. FIG. 1B illustrates the inner workings of a swirl cup 44 taken from a typical nozzle such as the nozzle 30, wherein four lumens 46, 48, 50, 52 are aimed to cause four tangential pressurized liquid flows to enter a spinning chamber 54. The resulting continuously spinning liquid flows combine and emerge from a central discharge passage 56 in the swirl cup as a substantially continuous spray 32 of droplets of varying sizes, including the "fines" or miniscule droplets of fluid which many users find to be useless.

Figure 1C:
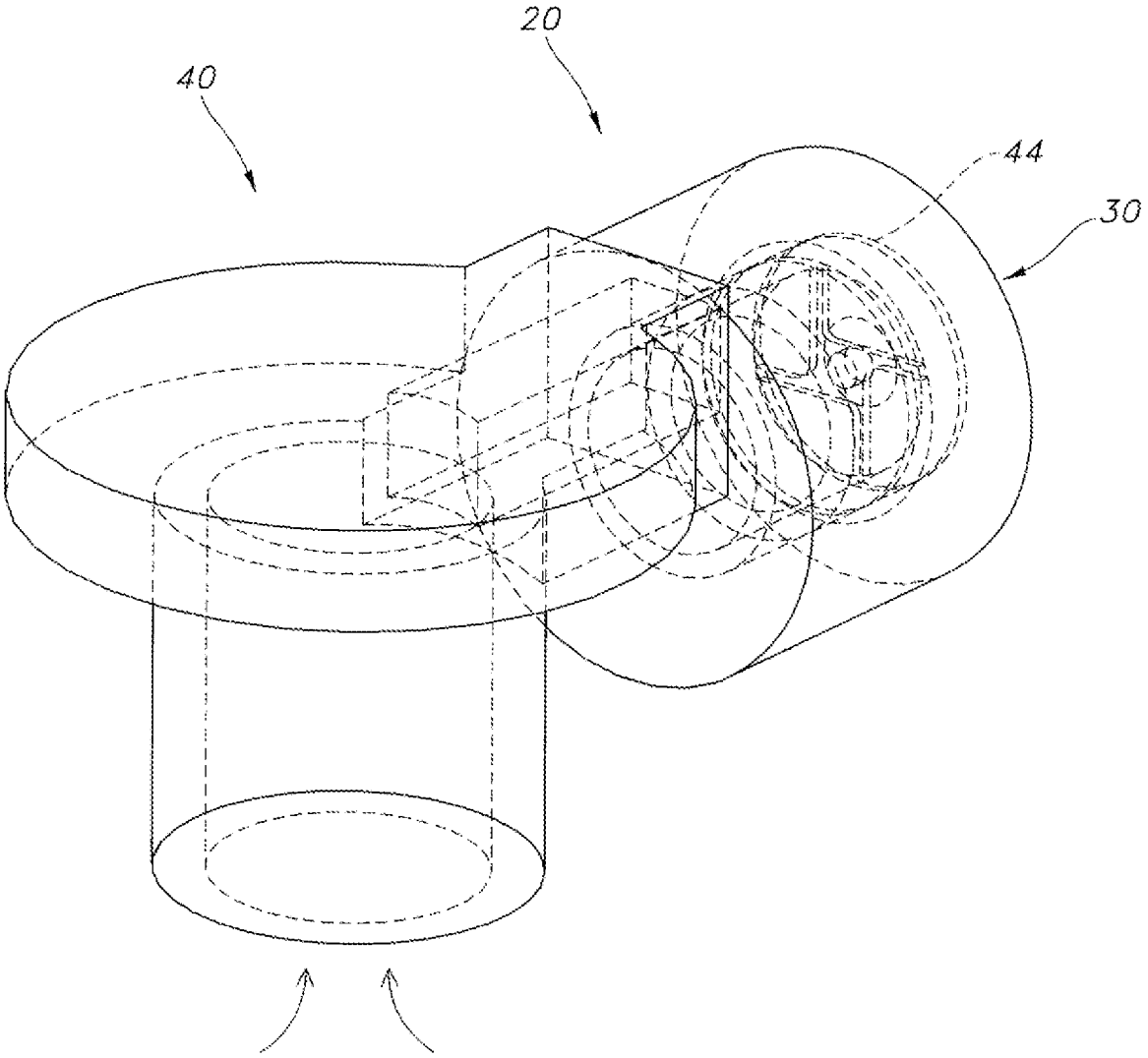
FIG. 1C (PRIOR ART)
FIG. 1C is a schematic diagram illustrating a typical actuator and nozzle assembly including the standard swirl cup of FIGS. 1A and 1B as used with aerosol sprayers, in accordance with the Prior Art.

FIG. 1C is a diagrammatic partial perspective view illustrating the typical prior art aerosol package 20 of FIGS. 1A and 1B, incorporating the actuator 40 and nozzle 30 and including a standard swirl cup 44 as used with aerosol sprayers, where the solid lines illustrate the outer surfaces of the actuator 40 and the phantom or dashed lines show hidden features including the interior surfaces of swirl cup 44. As illustrated, the swirl cup 44 is fitted onto the actuator 40 and used with either a manually pumped trigger sprayer or a pressurized aerosol sprayer such as that illustrated at 20 in FIG. 1A. This prior art is a simple construction that does not require an insert and a separate housing. As will be further described hereinafter, the present invention builds upon the concept illustrated in FIGS. 1A-1C, but replaces the swirl cup's "spin" geometry with a new fluidic circuit geometry enabling fluidic sprays (instead of a swirl spray) with viscous fluid products. As noted above, swirl sprays typically have a round, or circular cross-section, whereas fluidic sprays are characterized by planar, rectangular or square cross sections with consistent droplet size. Thus, the spray from a nozzle assembly made in accordance with the present invention can be adapted or customized for various applications while still retaining the simple and economical construction characteristics of a "swirl" cup.

Figure 1D:
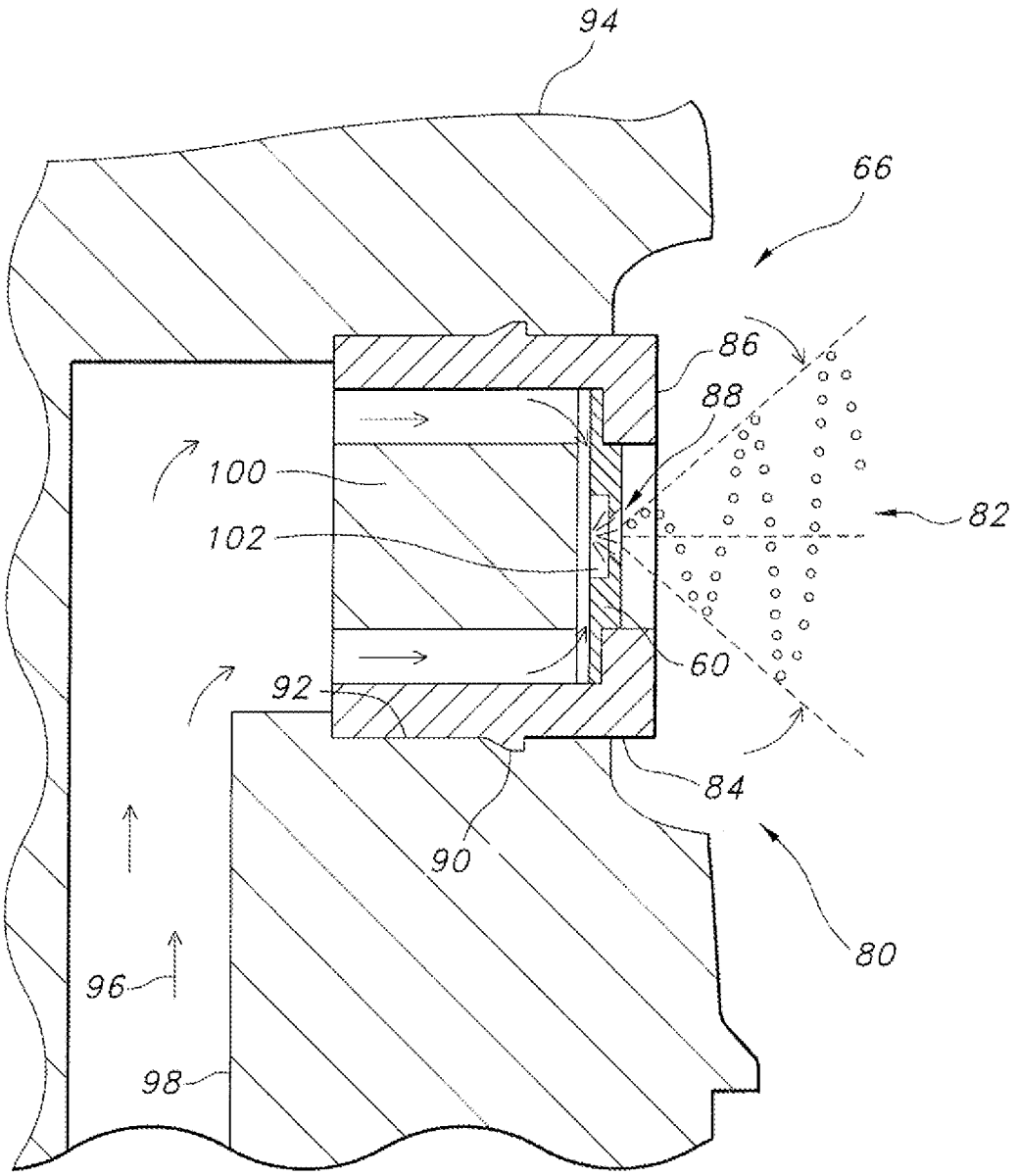
FIG. 1D is a cross-sectional diagram illustrating a nozzle assembly in an actuator body having a bore with a distally projecting sealing post, and showing a fluidic cup installed over the distally projecting sealing post, in accordance with the applicant's prior art.
Figure 1E:
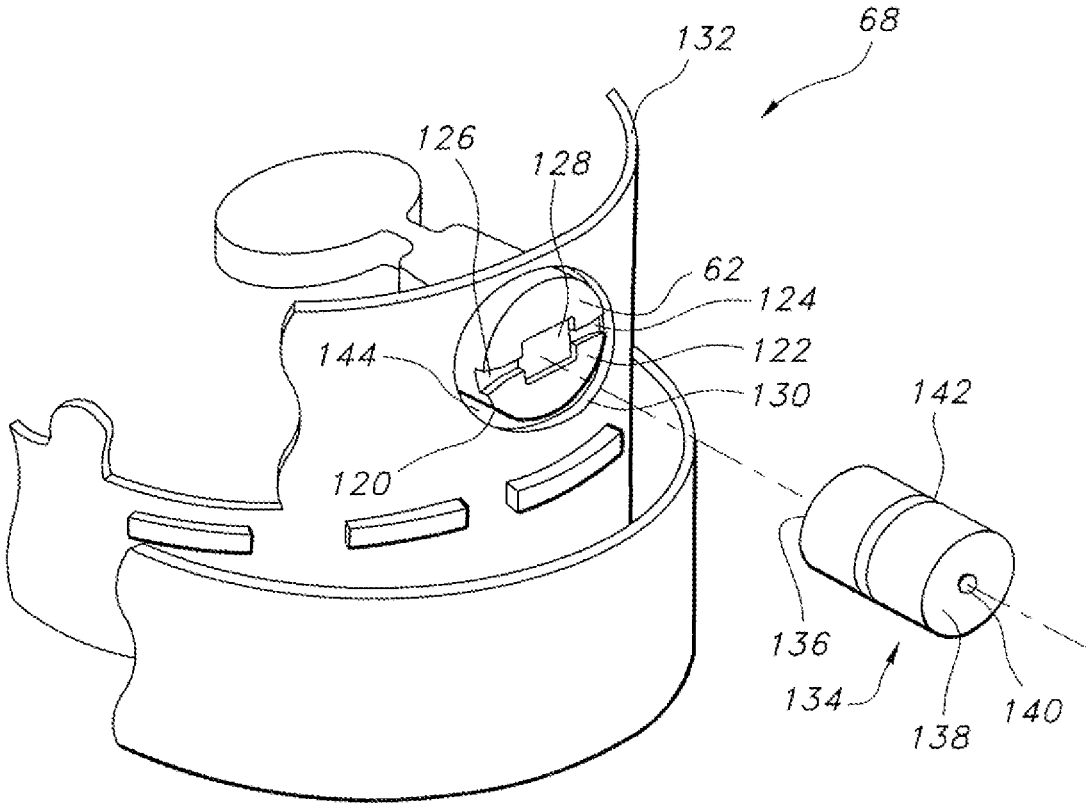
FIG. 1E is an exploded perspective partial view illustrating a nozzle assembly configured as an aerosol actuator for use with a pressurized container having a distally projecting post with a distal end surface configured with a molded in-situ fluidic geometry and adapted to carry a fluidic nozzle component configured as a cylindrical cup having a substantially open proximal end and a substantially closed distal end wall with a centrally located power nozzle defined therein and covering the post, in accordance with the applicant's prior art.
Figure 1F:
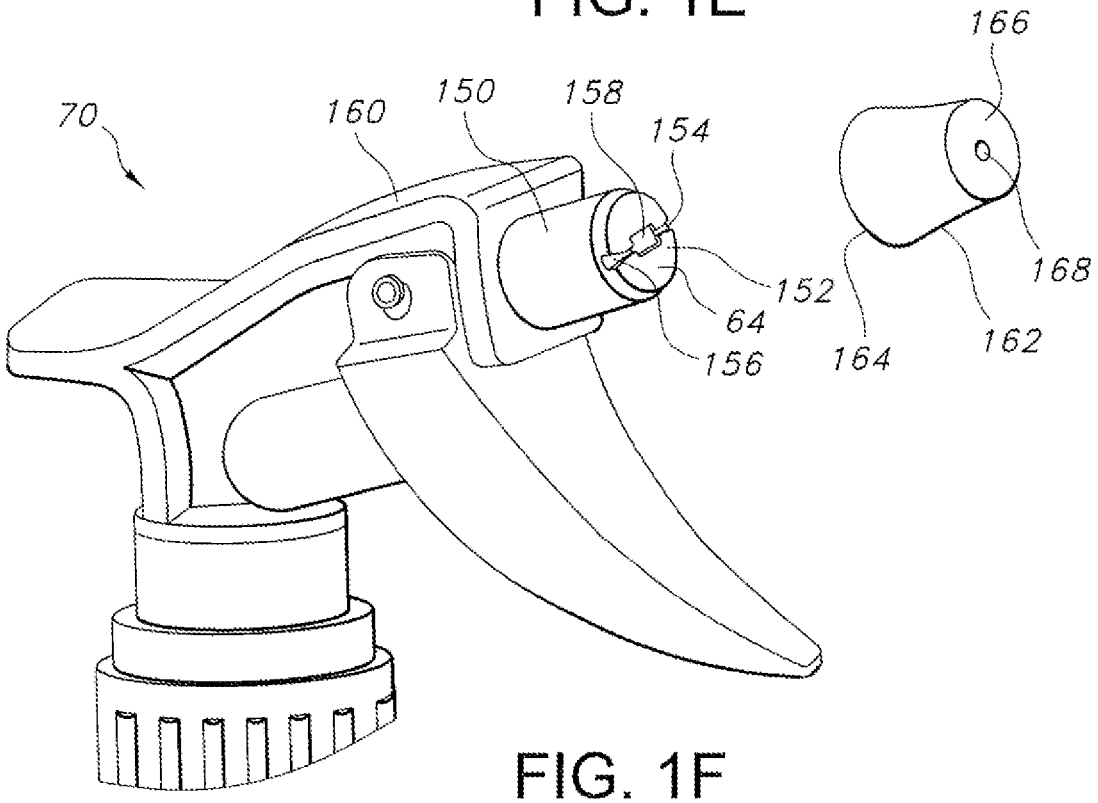
FIG. 1F illustrates an exploded perspective partial view of a nozzle assembly configured as an trigger spray actuator having a distally projecting post with a distal end surface configured with a molded in-situ fluidic geometry and adapted to carry a fluidic nozzle component configured as a cylindrical cup having a substantially open proximal end and a substantially closed distal end wall with a centrally located power nozzle defined therein and covering the post, in accordance with the applicant's prior art.

FIGS. 1D-1F illustrate at 60, 62 and 64, respectively, three embodiments of Applicant's own fluidic oscillators configured in nozzle assemblies 66, 68 and 70 for use with disposable or portable sprayers for use with thin (non-viscous) fluid products as described in greater detail in previously-mentioned U.S. Pat. No. 9,0898,856. As illustrated in FIG. 1D herein (which is FIG. 9B of the '856 Patent) the assembly 66 incorporates a flag mushroom fluidic cup 80 which is configured to emit a spray 82 comprised of a single moving jet oscillating in space in the plane of the centerline of the fluidic circuit power nozzles (not shown) to form a flat fan spry. The cup has a cylindrical sidewall 84 terminating distally in a closed distal end wall 86 with a discharge orifice 88. The side wall 84 incorporates a radially projecting circumferential, or annular, retention bead for securing the cup in a bore 92 formed in actuator body 94. Liquid product or fluid to be sprayed, illustrated by arrows 96, flows through passageway 98, around a sealing post 100 and into the power nozzles of fluidic oscillator assembly 60, and from the power nozzles into an interaction region 102 to generate the outlet spray 82.

Figure 14:
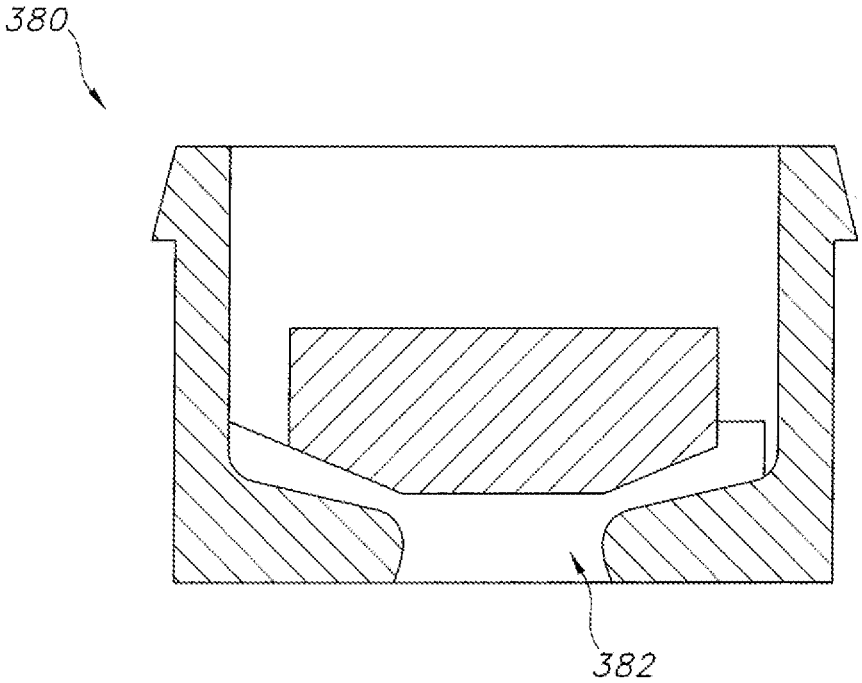
FIG. 14 is a cross-sectional view of the embodiment of FIG. 13, in accordance with the present invention.

In Applicants' fluidic oscillator sprayer embodiment illustrated in FIG. 1E (which is FIG. 14 in the '856 patent), the nozzle assembly 68 is configured as an aerosol actuator for use with a pressurized container adapted to spray a fluid product such as sun screen in a selected spray pattern. The nozzle assembly has a transversely aligned, distally projecting sealing post 120 with a distal end surface 122 configured with a molded in-situ fluidic oscillator 62 having opposing power nozzles 124 and 126 directing fluid flow into a central interaction region 128. Post 120 projects through an annular bore 130 in actuator body 132 and sealably engages and carries a fluidic nozzle component 134 configured as a cylindrical cup. The cup has a substantially open proximal end 136 and a substantially closed distal end 138 with a centrally located nozzle aperture 140 defined therein, and covers the post when assembled. The cup 134 carries a circumferential, annular retention bead 142 which snap fits into sealing engagement with the actuator body 132 within bore 130 to provide resilient engagement of the cup bead within the bore.

Nozzle assembly 68 is similar to assembly 66 of FIG. 1D, but differs in that the end surface 122 of the sealing post 120 of assembly 68 has conformal fluidic geometry molded therein, including the substantially rectangular interaction region 128 in fluid communication with the venture-shaped power nozzles 124 and 126. The axes of these nozzles, which direct fluid from an annular lumen 144 around the sealing post into the interaction region, preferably are aligned to create colliding flows of pressurized fluid in the region 128 at a selected inter-jet impingement angle of 180 degrees. When the cup-shaped member 134 is fitted to the sealing post 120, and pressurized fluid is introduced, oscillating flow vortices are generated in the interaction region by the impinging fluid jets from the opposed power nozzles.

A third embodiment of Applicants' fluidic oscillator sprayer is illustrated in FIG. 1F (which is FIG. 14 of the '856 patent), wherein the assembly 70 is configured as a part of a trigger spray actuator having a transversely aligned, distally projecting sealing post 150 with a distal end surface configures with molded in-situ fluidic geometry including opposing power nozzles 154 and 156 in fluid communication with a central interaction region 158. The sealing post projects from the from the spray actuator body 160 and receives and sealingly engages fluidic nozzle component 162 configured as a cylindrical cup which covers the post. The cup has a substantially open proximal end 164 and a substantially closed distal end wall 166 with a centrally located nozzle aperture 168. This nozzle differs from the configuration of FIG. 1D in that the distal end surface of the sealing post incorporates a conformal fluid geometry molded therein. As with the embodiment of FIG. 1E, the interaction region 158 is substantially rectangular, and the power nozzles 154 and 156 are Venturi-shaped to pass pressurized fluid from a surrounding lumen to the region 158. The axes of these nozzles, which direct fluid from an annular lumen around the sealing post into the interaction region, preferably are aligned to create colliding flows of pressurized fluid in the region 158 at a selected inter-jet impingement angle of 180 degrees. When the cup-shaped member 162 is fitted to the sealing post 150, and pressurized fluid is introduced, oscillating flow vortices are generated in the interaction region by the impinging fluid jets from the opposed power nozzles.

Figure 2:
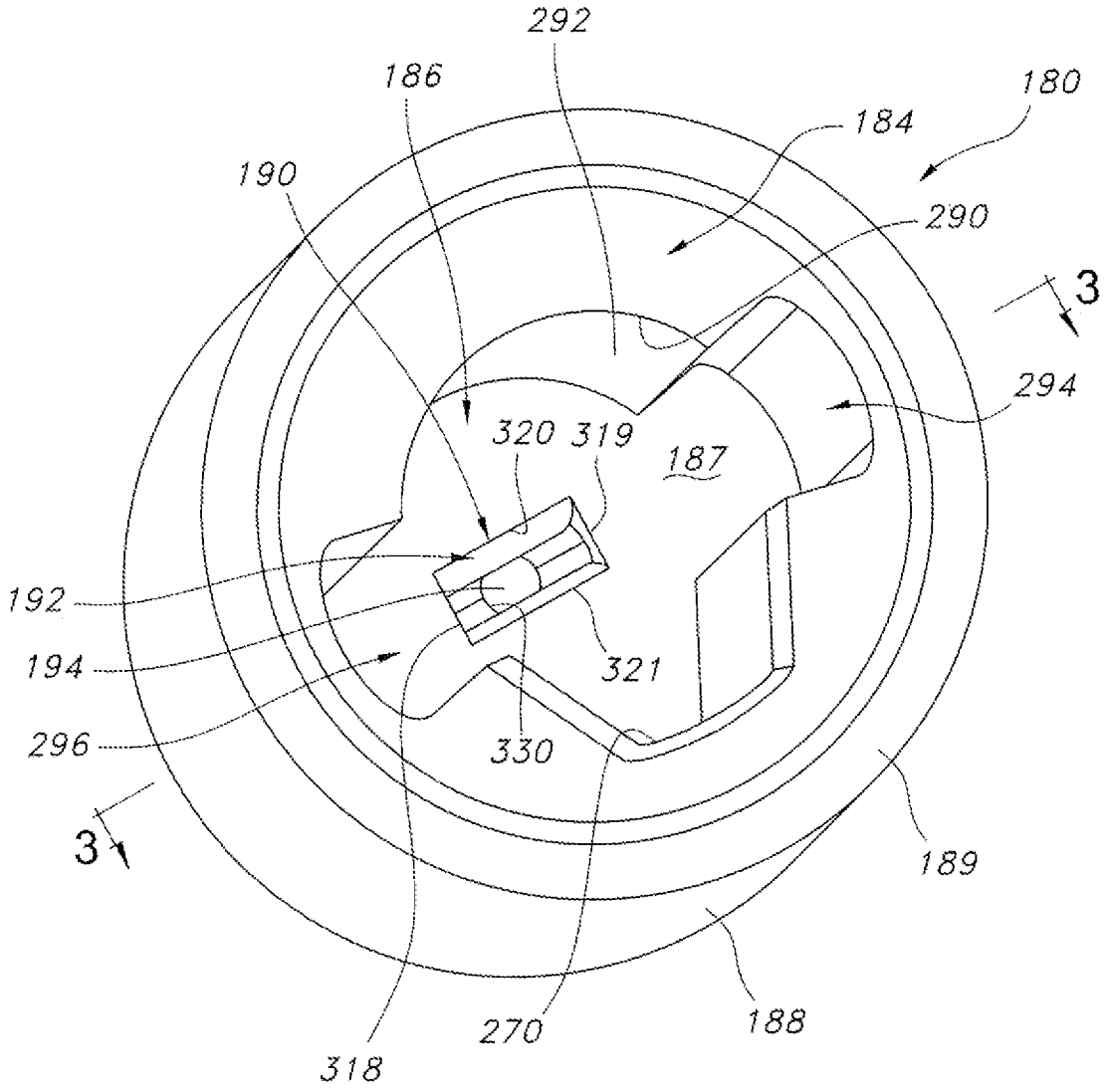
FIG. 2 is a bottom perspective view illustrating the inner or proximal surfaces of a conformal, flag mushroom cup-shaped fluidic nozzle component configured as a cylindrical cup having a substantially open proximal end and a substantially closed distal end wall having a centrally located interaction chamber and exit orifice lumen defined therein, in accordance with the present invention.
Figure 3:
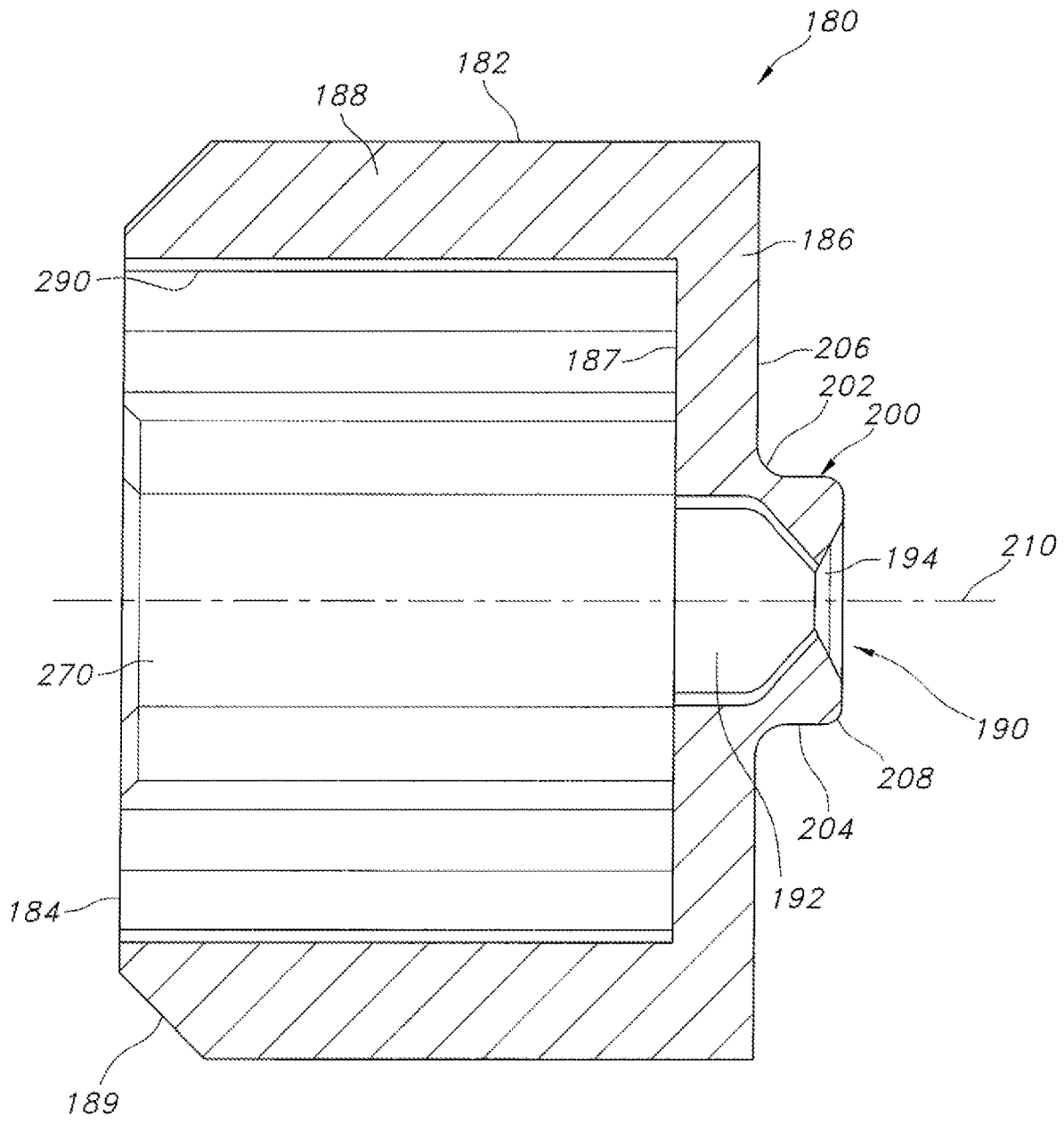
FIG. 3 is a cross-sectional side view of the nozzle assembly cup member taken along lines 3-3 of FIG. 2.
Figure 4:
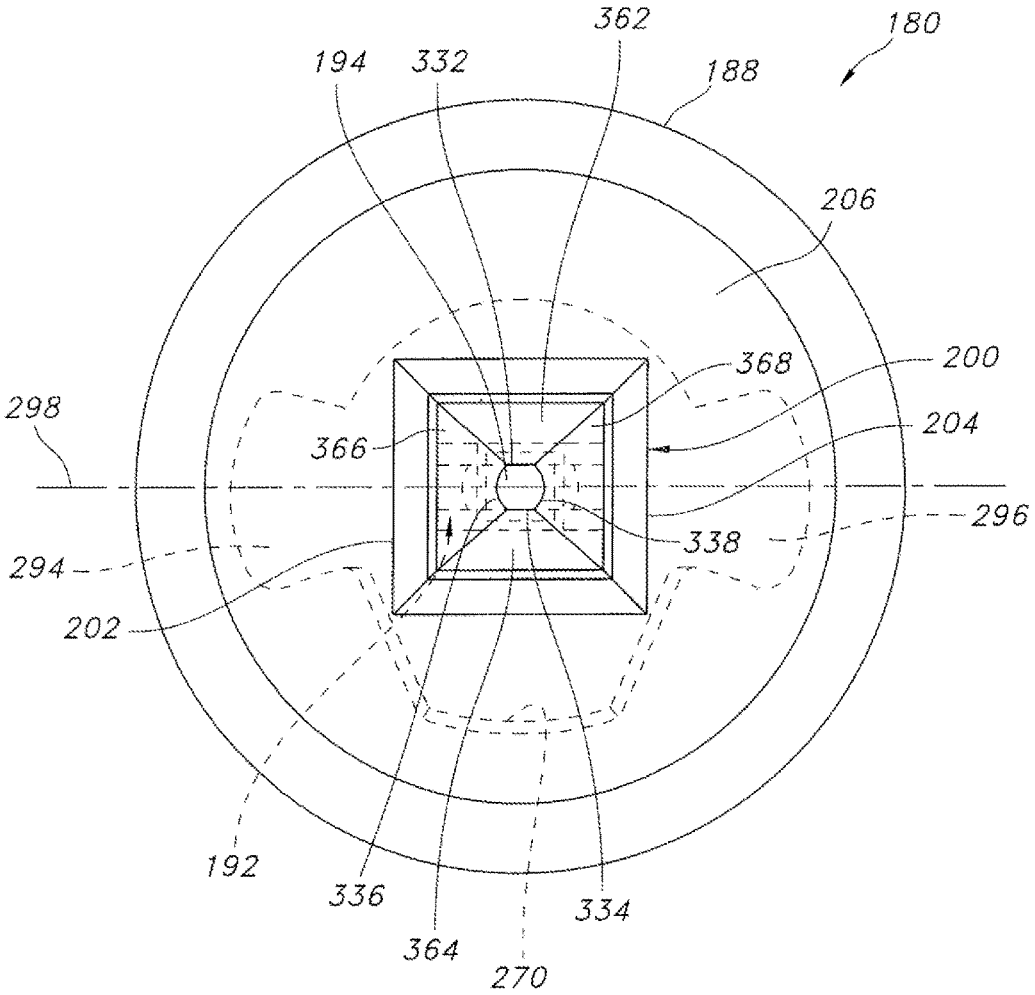
FIG. 4 is a head-on or front elevation view of the exterior distal end of the conformal, flag mushroom cup-shaped member of FIG. 2, and illustrating a distally projecting rectangular boss or snout on a substantially closed distal end wall, and a centrally located exit orifice defined between first and second distally projecting rectangular boss sidewalls which may be used as tool engagement surfaces for alignment or orientation of the cup member during or after installation, in accordance with the present invention.

Turning now to a detailed description of the spray nozzle assembly of the present invention, FIGS. 2-14 illustrate structural features of exemplary embodiments of a novel conformal flag mushroom cup oscillator nozzle and further illustrate the method of assembling and using the invention in spraying selected fluids. More particularly, FIG. 2 is a bottom perspective view illustrating the inner or proximal surfaces of a conformal, flag mushroom cup-shaped fluidic nozzle component 180 configured as a cylindrical cup having a substantially open proximal end 184, a substantially closed distal end wall 186 having an interior surface 187, and a cylindrical side wall 188 beveled at 189 at its proximal end. The interior, or proximal surface 187 of the end wall 186 incorporates upper fluidic circuit components 190 including a centrally located rectangular interaction chamber 192 and an exit orifice lumen 194 defined therein in accordance with the present invention. FIG. 3 is a cross-sectional view of flag mushroom cup-shaped nozzle member 180 taken along lines 3-3 of FIG. 2, and FIG. 4 is a head-on or front elevation view of the exterior distal end of the conformal, flag mushroom cup-shaped member of FIG. 2. The cup 180 is mounted in a sprayer housing package or assembly 196 (FIGS. 5-9) and is configured to spray an oscillating sheet of fluid droplets distally from a sprayer assembly similar to those illustrated in FIGS. 1A-1F. The cup-shaped nozzle 180 of the present invention differs in that it can be adapted to provide multi-lip and multi-power nozzle embodiments, as described further below and illustrated in FIGS. 2-12.

The flag mushroom cup-shaped nozzle assembly 180 incorporates a distally projecting rectangular boss or snout 200 on the substantially closed distal end wall 186, with the centrally located exit orifice 194 being defined between first and second opposed, distally projecting rectangular boss sidewalls 202 and 204 which may be used as tool engagement surfaces for alignment or orientation of the cup member 180 during or after installation, in accordance with the present invention. The protruding boss or snout 200 extends distally away from the front of the wall 186 and is provided to avoid sprayed droplet attachment (via the Coanda effect) on the exterior distal surface or face 206 of nozzle cup distal end wall 186. The snout 200 has rounded edges 208 to ensure that the spray which projects distally along a central axis 210 of the cup 180 does not attach to the snout surface or the front wall.

Figure 5:
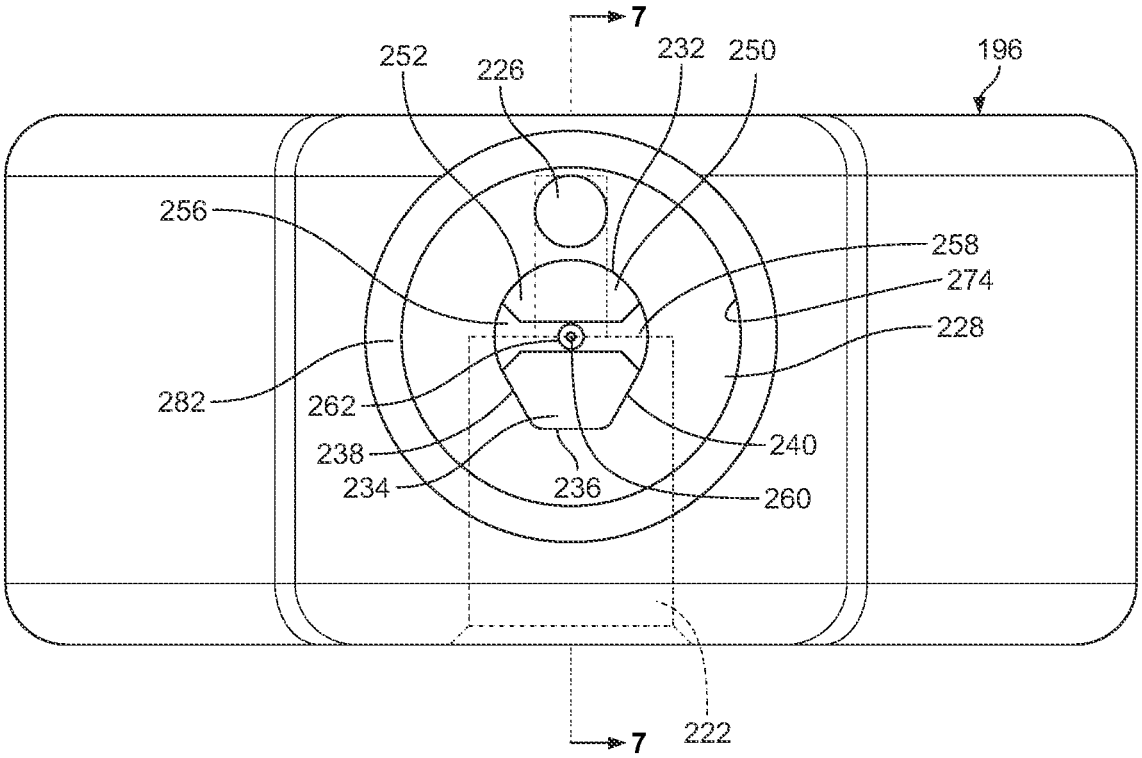
FIG. 5 is a head-on or front elevation view of the distal end of a sprayer housing assembly adapted to receive the cup-shaped member of FIGS. 2-4, but with the cup-shaped member removed.
Figure 6:
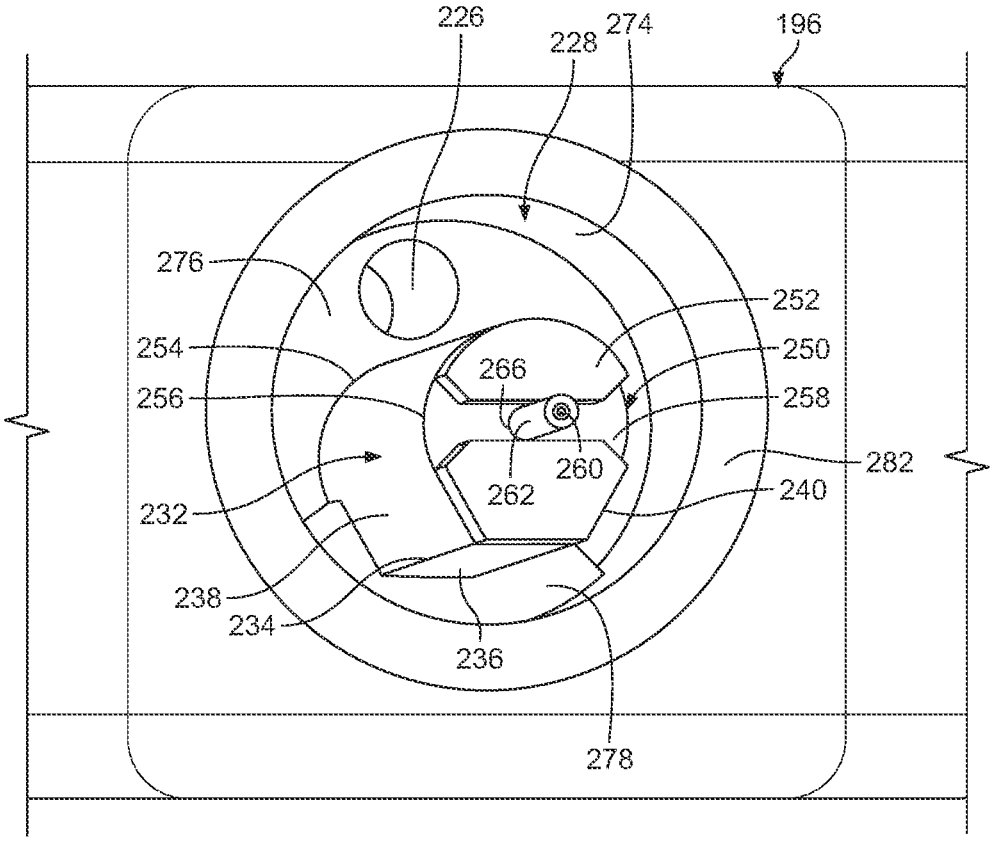
FIG. 6 is a front perspective view of the nozzle assembly housing of FIG. 5, illustrating a distally projecting indexed sealing post and showing a small conical or dome-shaped axial protuberance projecting from the sealing post's distal face within opposing first and second power nozzle troughs or grooves, in accordance with the present invention.
Figure 7:
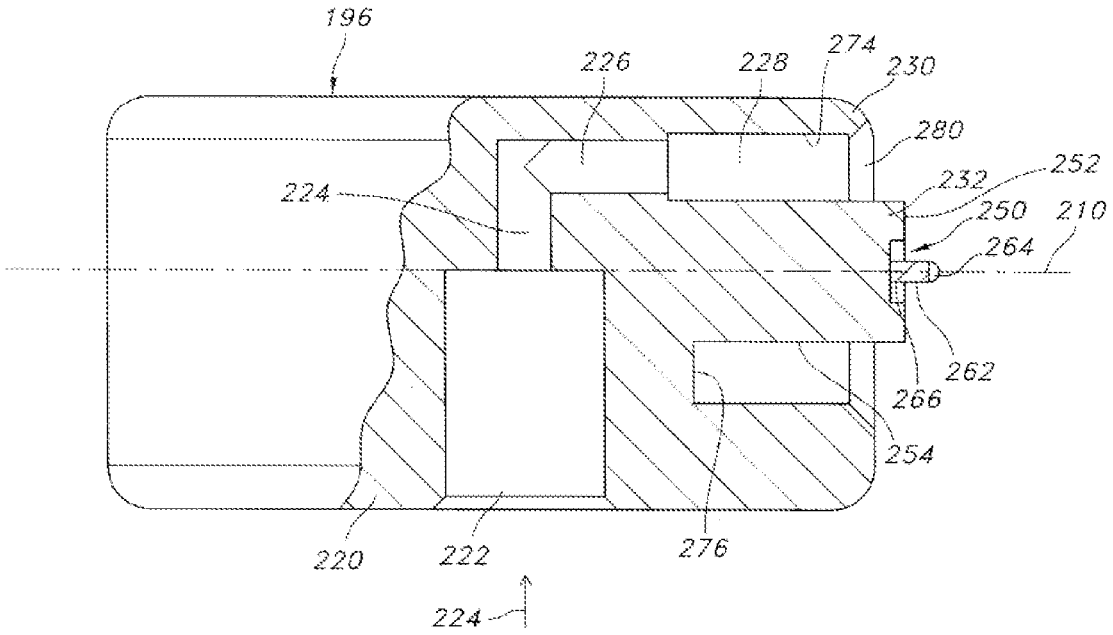
FIG. 7 is a cross-sectional side view of the nozzle assembly housing, taken along lines 7-7 of FIG. 5, in accordance with the present invention

As illustrated, FIG. 5 is a head-on or front elevation view of the distal end of the sprayer housing assembly 196 adapted to receive the cup-shaped member 182 of FIGS. 2-4, but with the cup-shaped member removed. FIG. 6 is a front perspective view of the sprayer housing assembly of FIG. 5, while FIG. 7 is a cross-sectional view taken along lines 7-7 of FIG. 5. The housing assembly body 210 incorporates fluid supply passageways 222, 224 and 226 for receiving pressurized fluid 224 from a source (not shown) and directing it to a bore 228 formed in the forward, or distal end 230 of the housing. Located in the bore 228 as a part of the housing assembly and extending forwardly out of the housing 196 is a distally projecting cylindrical sealing post 232 having a radially outwardly-extending indexing key or projection 234 extending along its axial length. Key 234 is illustrated as having flat outer and side surfaces 236, 238 and 240 which will engage a correspondingly-shaped key groove, to be described, in the interior of cup member 180 when the sprayer is assembled, so that the cup member is positioned with a pre-defined angular orientation in the sprayer housing over the sealing post 232. The combination of the flag mushroom cup 180 and the cooperating post member 232, when assembled, define a desired fluidic circuit oscillator geometry.

Figure 11:
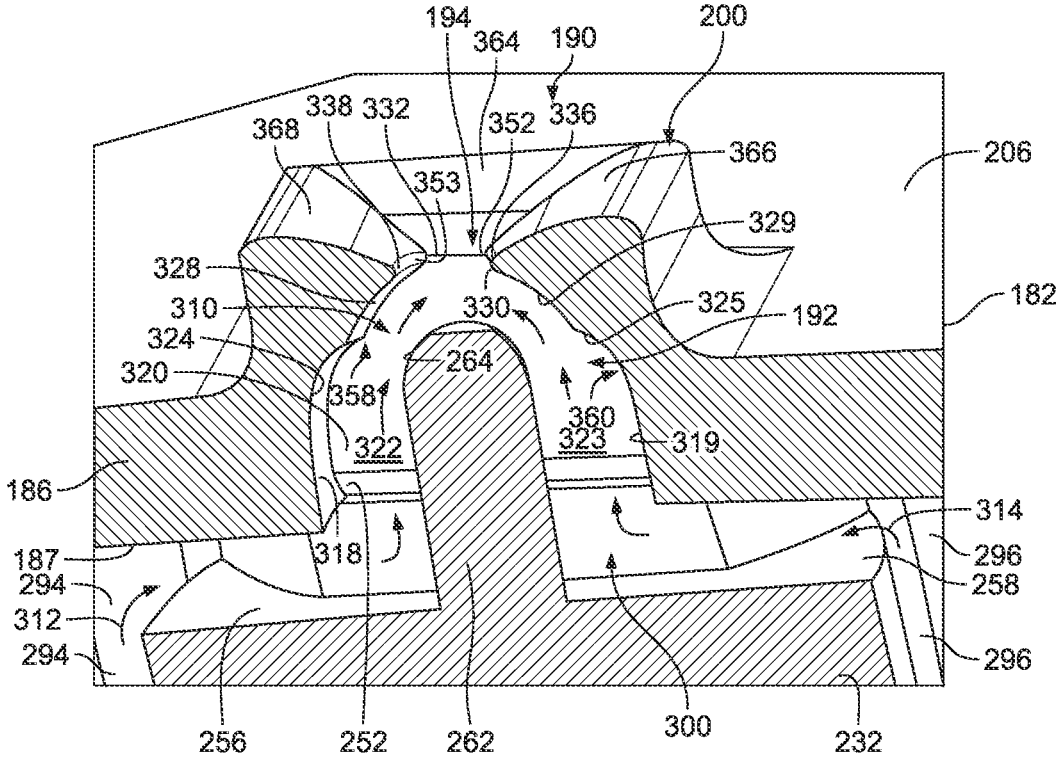
FIG. 11 is an enlarged perspective cross-sectional view of the interaction region within the nozzle assembly of FIGS. 8-10.

As described with respect to FIGS. 2-4, an upper, or forward part of this geometry is incorporated in the cup at 190; the remainder of the fluidic circuit includes lower, or rearward fluidic circuit components 250 incorporated on the distal, or outer end face 252 of the sealing post, as best seen in FIGS. 5 and 6. The sealing post 232 has a cylindrical peripheral wall 254 terminating at the distal or upper end face 252, with first and second opposed lower power nozzle channel components 256 and 258 formed, as by molding, in the upper face and extending radially inwardly from the side wall 254 toward a central point 260 which corresponds to; i.e., lies on, the central axis 210 of the nozzle cup 180. At the central point where the first and second power nozzle channels intersect, the channels each have a selected cross sectional area defined by a channel depth and a channel width. Also at this point, the sealing post carries on its distal face 252 a small, distally-, or axially-projecting cylindrical protuberance, post or stub 262 which projects along the central or spray axis 210 and which terminates in a conical or dome-shaped distal end 264 (FIGS. 7 and 11). The distally projecting axial protuberance or stub 262 has an external diameter at its base 266 which is substantially equal to the width of the lower power nozzle channels 256, 258 at this point to crush on the walls (i.e., 90 degrees to the fluidic circuit) to form the two flow paths leading to the exit orifice 194. This crushed sealing engagement prevents flow of fluid between the lower power nozzle channels and directs the flow distally along the stud into and through the interaction chamber 192.

Figure 8:
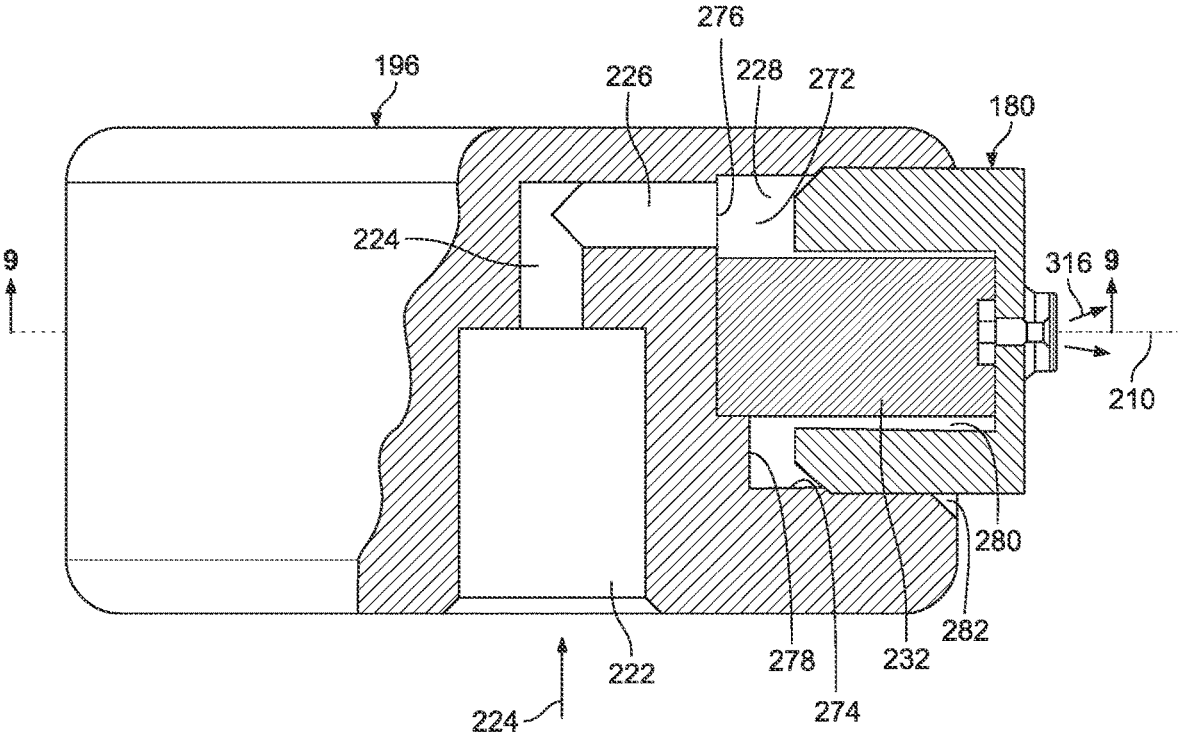
FIG. 8 is a side view in partial cross-section, illustrating the nozzle assembly of the present invention including the cup member mounted in the housing and coaxially aligned and engaging the indexed sealing post, with the small conical or dome-shaped axial protuberance projecting from the sealing post's distal face into the end wall of the cup, in accordance with the present invention.
Figure 9:
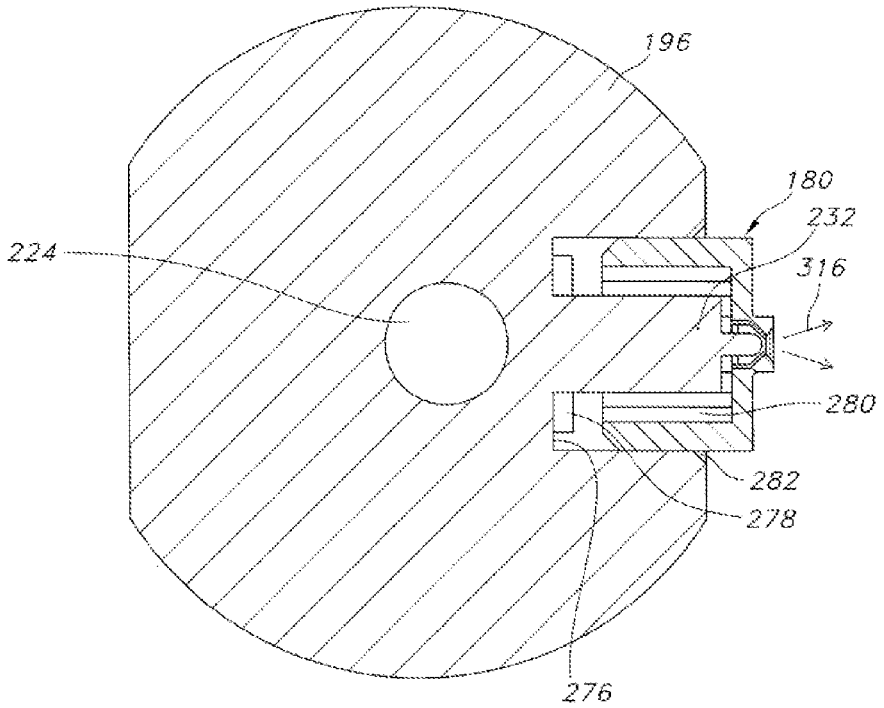
FIG. 9. is a cross-sectional bottom view of the nozzle assembly of the invention, taken along lines 9-9 of FIG. 8.

To assemble the sprayer of the invention, the cup member 180 is placed into the bore 228 of the housing assembly 196 in a pre-defined angular orientation with respect to the cooperating sealing post member 232, which is located in the middle of the nozzle assembly bore 228, as best seen in FIGS. 5 and 6. When assembled, the inner or proximal surface 187 of the distal end wall 186 of the cup 180 (FIG. 2) engages the distal end face 252 of the sealing post 232, as illustrated in FIGS. 8 and 9, with the stub 262 extending into the interaction chamber 192 formed in wall 186. The combination of the flag mushroom cup 180 and cooperating sealing post member 232, when assembled in proper angular alignment, brings together the upper and lower fluidic circuit components 190 and 250 to define the desired fluidic circuit oscillator geometry.

Alternative embodiments of this fluidic geometry may be made by defining the power nozzle channels in the cup member. More specifically, power nozzle channels 256, 258 may be fabricated into or defined as grooves or depressions within the interior surface of cup member 180 so that distal upper face 252 of sealing post 232 is substantially planar, except for distally projecting stub 260. The assembled components (cup member 180 sealed upon sealing post 232) together define the fluidic circuit's lumens or channels including power nozzle channels 256, 258. When the cup-shaped flag mushroom fluidic circuit defining cup member 180 is mounted in the bore 228 of actuator body member 196 it is forced by an indexing slot 270 in the cup wall, which engages the indexing key 234 defined on the sealing post sidewall, to engage the cooperating sealing post 232 at the prescribed angular orientation about central axis 210. This orientation is required to ensure that the cup is in correct alignment with the sealing post to align the upper (or distal) fluidic circuit components 190 defined in the interior wall 187 of the cup with the lower (or proximal) fluidic circuit components 250 defined in the sealing post 232, as illustrated in FIGS. 2 and 3 and in phantom in FIG. 4, as well as in the enlarged view of FIG. 11.

The bore 228 in the nozzle assembly body member 196 has a cylindrical peripheral side wall 274 spaced radially outwardly of the cooperating sealing post 232 to provide a substantially annular chamber which receives the cylindrical side wall 188 of the cup-shaped member 182 (see FIGS. 8 and 9). The bore has a radially extending bottom wall 276 with an inner face which has a raised portion 278 (FIGS. 6, 8 and 9) to define a stepped annular surface which is substantially perpendicular to central axis 210 to provide a plenum volume 280 above the wall (or forwardly of the wall in a distal direction). This plenum extends around the sealing post and within and below the cup 180, and is in fluid communication with the first and second fluid inlet channels 224 and 226 in the housing 196. The cylindrical sidewall 274 of bore 228 in the nozzle assembly housing has an outwardly flared exit 282, and is sized to snugly receive and support the cylindrical outer wall 188 of cup member 180, as illustrated in FIGS. 8-10.

Figure 10:
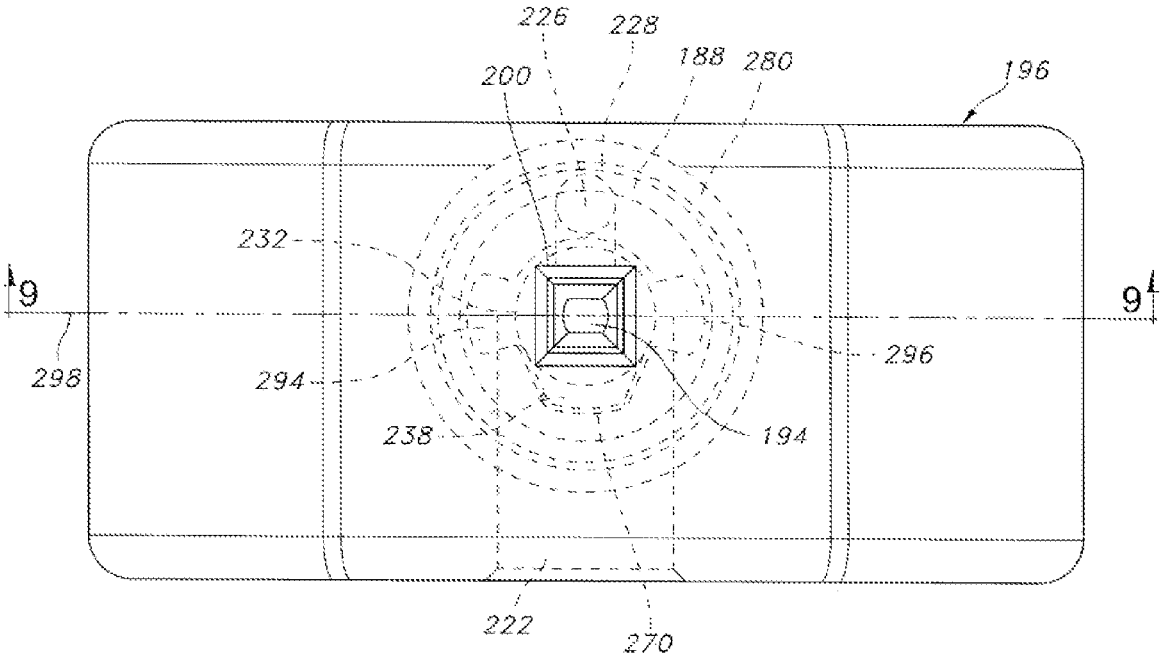
FIG. 10 is a head-on or front elevation view of the distal end of the sprayer housing assembly of FIGS. 8 and 9.

As best seen in FIGS. 2 and 3, and illustrated in phantom in FIG. 10, the interior surface 290 of the cylindrical sidewall 188 of cup 180 is configured to include the key slot 270, as described above, on one side of the central axis 210. Diametrically opposite the key slot the inner surface 290 is configured to be generally cylindrical, as at 292, to closely engage a corresponding cylindrical portion of peripheral wall 254 of the sealing post 232. The inner surface 290 is further shaped to be spaced away from the opposite sides of the peripheral wall 254 of the sealing post to form opposed longitudinal fluid flow channels 294 and 296 on opposite sides of the key 234. Channels 294 and 296 are part of the plenum 280 and extend along the axial length of the side wall 188 of the cup 180, with the two channels being generally aligned with a transverse axis 298. These channels are formed in the interior of the cup 182 so that when the cup and housing are assembled, as illustrated in FIGS. 8-10, the flow channels in the cup are aligned at their upper (distal) ends with the outermost ends of respective lower fluid power nozzle components 256 and 258 on the sealing post in the housing, which channels also extend along axis 298. The flow channels thereby define pathways for fluid product to flow from a container into the assembled fluidic geometry components 190 and 250, which form an assembled fluidic geometry 300 illustrated in FIG. 11 as being defined between the flag mushroom cup member 180 and the cooperating sealing post 232.

As best seen in the enlarged view of the fluidic circuit structure 300 in FIG. 11, when the cup 180 is positioned in the housing 196, the inner surface 187 of end wall 186 sealingly engages the top end 252 of the sealing post 232. In this position, the distal end 264 of protrusion, post or stub 262 extends into, and is centered in, the interaction chamber 192 of the distal portion 190 of the assembled fluidic circuit 300. Between the distal end 264 of the stub and the exit orifice 194 the interaction chamber defines an interaction region 310 within the cup-shaped member 180. Further, the interior surface 187 of the wall 186 cooperates with and covers the outer ends of the channels formed in the upper surface 252 of the sealing post 232 to define the tops of the first and second power nozzle components 256 and 258 which are preferably Venturi-shaped or tapered channels or grooves. The first power nozzle component is configured to accelerate the movement of pressurized fluid indicated by arrows 312 to form a first jet of fluid which impinges on one side of the axial protuberance 262 and is deflected distally, or upwardly as viewed in FIG. 11 toward the interaction region. Similarly, the second power nozzle is configured to accelerate the movement of pressurized fluid indicated by arrows 314 to impinge on the opposite side of the axial protuberance 262 and is deflected distally, or upwardly as viewed in FIG. 11 toward the interaction region 310.

The cup member's interaction region 310 and exit orifice 194 components of the distal fluidic circuit 190 are preferably molded directly into the interior wall of the cup 180. When molded from plastic as a one-piece cup-shaped member, the flag mushroom cup 180 is easily and economically fitted onto the cooperating indexed sealing post 232 in the sprayer housing, or actuator 196, with the distal or outer face 252 in sealing engagement with the inner face 187 of the cup-shaped member wall 186. The peripheral wall 236 of the sealing post and the inner peripheral wall 290 of cup 180 are spaced radially at regions 294 and 296 to define fluid flow channels. The walls 236 and 290 are generally parallel with each other to define fluid flow paths of substantially constant cross section, but may be tapered or may include step discontinuities (e.g., with an abruptly smaller or stepped inside diameter) to aid in developing greater fluid velocity and instability. Whatever the configuration, when the cup-shaped member is fitted onto the indexed sealing post and pressurized fluid product is introduced (e.g., by pressing an aerosol spray button to releasing a propellant-driven product or operating a trigger sprayer's hand squeezed pump), the pressurized fluid enters the fluid channels 294 and 296, flows through the respective power nozzles 256 and 258, and is directed distally into the interaction region 310 to generate at least one oscillating flow vortex within the interaction region.

Figure 12:
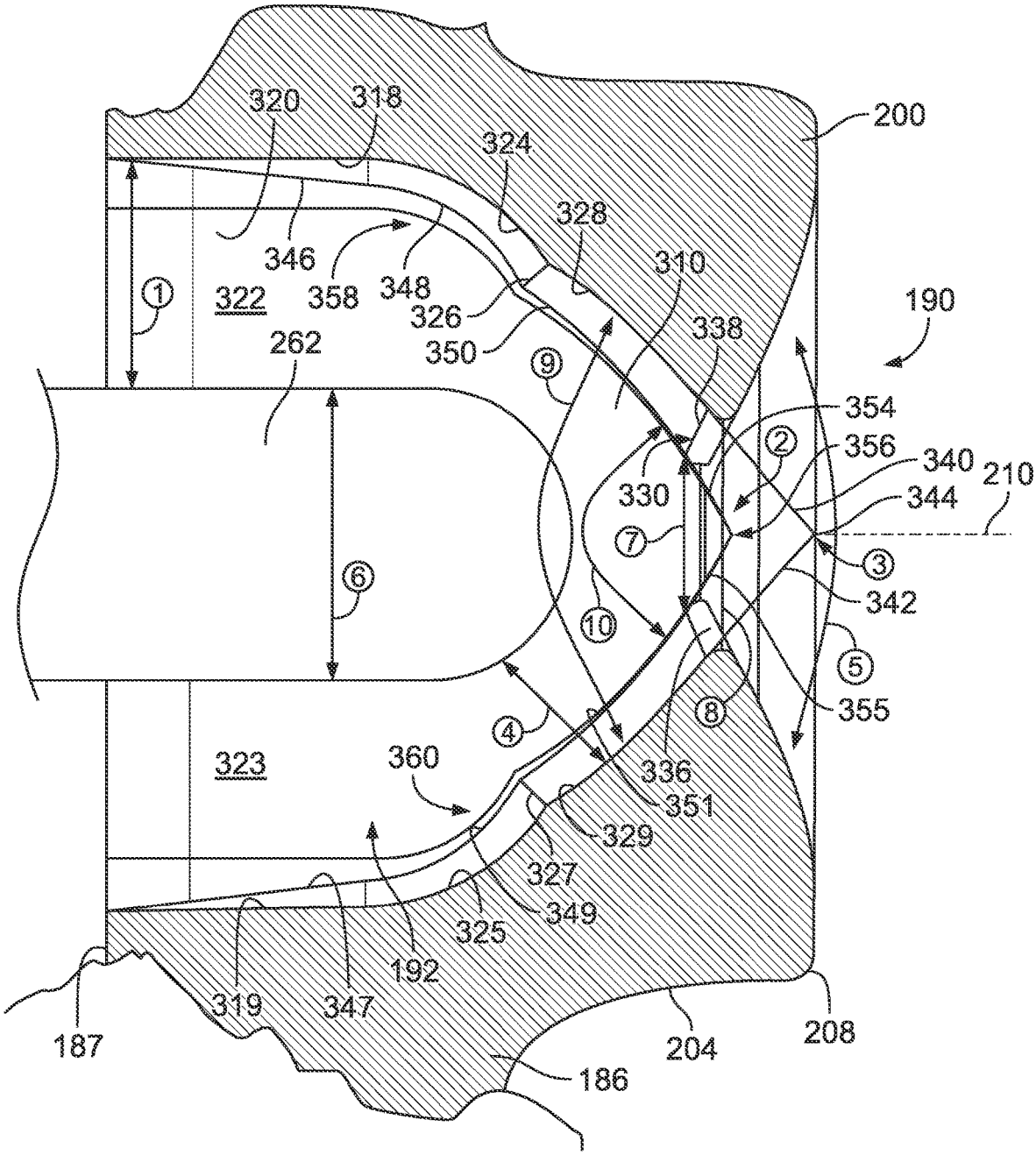
FIG. 12 is a diagrammatic view resembling a cross section at the center of the fluidic circuit and illustrating critical dimensions for the nozzle assembly of FIGS. 2-11, in accordance with the present invention.
Figure 13:
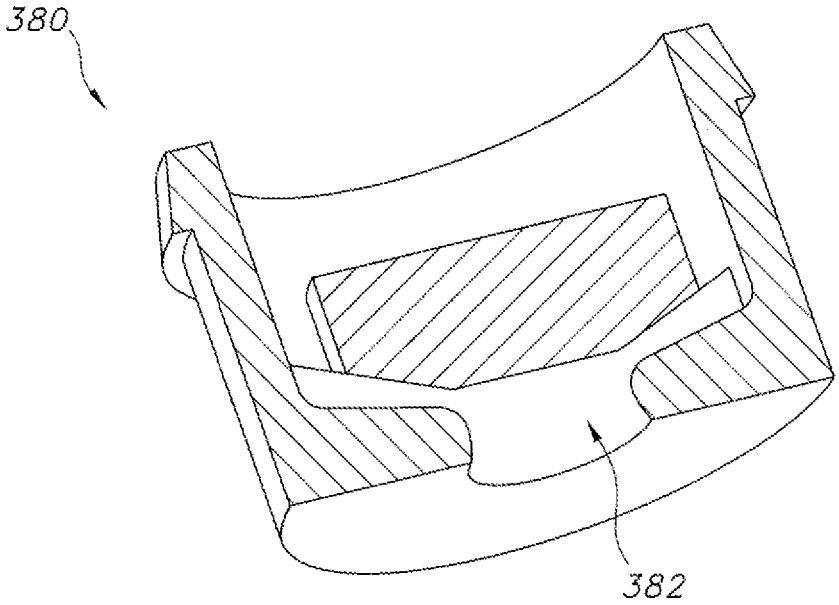
FIG. 13 is a perspective cross section view of another embodiment of the invention, illustrating a $2^{nd}$ generation mushroom cup member adapted for use with a conical or tapered sealing post in a nozzle assembly.

Referring specifically to FIGS. 11 and 12, first and second fluid jets exit their respective power nozzles (256 and 258), and those first and second fluid jets impinge upon one another and generate an oscillating sheet which projects distally and exits the throat or exit orifice. The concave curved walls of the power nozzles define curved surfaces with a range of impingement angles (ranging from 10 to 9 as illustrated in FIG. 12. The streamlines of the first and second fluid jets flowing through the power nozzles follow the contours of the power nozzle walls. Within the single pair of impinging jets exists a continuous distribution of streamlines that impinge at angles within the range from the arcs shown in FIG. 12 as arcs (circled reference) "10" and "9". This range provides a lesser degree of impingement at the centered axial plane within the exit orifice and a greater degree of impingement at the edges of the exit (also referred to as the "floor & ceiling" of circuit). In the distally projecting product spray (316) Less impingement results in smaller fan angles, higher flow rates, and more center heavy distributions. More impingement results in larger fan angles, lower flow rates, and more heavy ended distributions. The specific configuration of circuit dimensions (including this range of impingement angles) is selected according to each unique product spray application's performance requirements.

It should be emphasized that any fluidic oscillator geometry which defines an interaction region to generate an oscillating spray of fluid droplets can be formed in the cup and sealing post, but, for purposes of illustration, conformal cup-shaped flag mushroom fluidic oscillators having an exemplary fluidic oscillator geometry are here described. FIG. 12 is a diagrammatic view resembling a cross section at the center of the fluidic circuit, along section lines 3-3 of FIG. 2, and illustrates critical dimensions for the nozzle assembly of FIGS. 2-11, in accordance with the present invention. The exemplary fluid circuit 190 of the cup nozzle 180 is the 3rd generation of the Applicant's flag mushroom cup nozzle assembly and is the preferred embodiment of the present invention. The method of packaging the fluid circuit components, with some components incorporated in the cup 180 and the rest incorporated on the sealing post, as employed in the preferred embodiment diagrammed in FIG. 12 permits smaller feature sizes and an enhanced ability to incorporate multi-lip geometry. This configuration is similar in some respects to that described in another of Applicant's patent applications; i.e., Appl. No. 62/077,616, the entire disclosure of which is incorporated herein by reference. The advantages of the present method and structure are critical for maintaining uniformity of spray distribution at low flowrates and high viscosities.

As best illustrated in FIGS. 2, 11 and 12, and as seen in phantom in FIGS. 4 and 10, the distal fluidic circuit portion 190 formed in the surface 187 of the cup 180 is generally rectangular is are sized to engage and cooperate with the proximal circuit components 250 on the sealing post 232. End walls 318, 319, perpendicular to axis 298 (FIG. 4) and side walls 320, 321 perpendicular to axis 298 define the periphery of the circuit 190 and enclose the interaction chamber 192. The axially aligned substantially planar walls defining the interaction region which are not terminated in the opposing lips are configured to crush or plastically deform and seal along the distally projecting stub's side wall when the cup member 180 is forced upon its sealing post 232.

The particular features of the fluid circuit 190 incorporated in the cup 180, and more particularly in the boss or snout 200 for the nozzle assembly of the invention are identified in FIG. 12 using the nomenclature set forth in the following Table 1, where the corresponding identifying numbers are circled in FIG. 12:

TABLE 1

| | |
|---|---|
| 1. | Feed height (Fh) |
| 2. | Outer Lip Intersection Location (OL-Il) |
| 3. | Inner Lip Intersection Location (IL-Il) |
| 4. | Power Nozzle height (Ph) |
| 5. | Outlet Angle (Oa) |
| 6. | Protuberance Diameter (PØ) |
| 7. | Minimum Throat Height (Th-min) |
| 8. | Maximum Throat Height (Th-max) |
| 9. | Inner Lip Intersection Angle (ILa) |
| 10. | Outer Lip Intersection Angle (OLa) |

Referring now to FIG. 12, the feed height (1) and feed width (dimension into the page), are the dimensions of the interaction chamber 192 which is defined in the cup 180 by the respective distances between the surface of stub 262 and walls 318, 319 (feed height) and between the surface of stub 262 and walls 320, 321 (feed width) when the nozzle is assembled to define respective fluid feed channels 322 and 323 through the interaction chamber. The walls 318 and 319 are spaced further from the protuberance than are walls 320 and 321 so that the feed height is greater than the feed width. The feed height needs to be larger because stub 262 needs to seal against the flat surfaces defining the interaction chamber without shutting off the fluid feed channels 322 and 323.

As illustrated, at the proximal end of chamber 192 the end walls 318 and 319 are generally parallel to the stub and to axis 210, but in a first step the walls curve inwardly toward the distal end of the stub in mirror images of each other, as illustrated by curved cross-sectional wall portions 324 and 325. At the distal ends 326 and 327 of the wall portions 324 and 325, the walls 318 and 319 are again stepped to curve in second mirror image steps inwardly at curved wall portions 328 and 329. In the illustrated embodiment, the second curvatures are at different angles than the curvatures of portions 324 and 325, and curve toward the throat 330 which is the entry to the exit orifice 194 and is spaced distally from the end of the protuberance 262. As illustrated in the plan view of the distal end of the cup 180 in FIG. 4, the exit orifice 194 for the interaction region, which is axially aligned with the distal end of stub 262 and with axis 210, is generally rectangular, with two opposed sides 332 and 334 being parallel to each other in the longitudinal direction of the orifice to define its length, and the other two opposed sides 336 and 338 being concave across the width of the orifice.

As viewed in FIGS. 11 and 12, the stepped curved wall cross-sections 328 and 329 lead to the centers of the concave ends 338 and 336, respectively, of the exit orifice and form an exit angle indicated by arrows 340 and 342 which intersect at a location (3), indicated at 344, distally of the orifice 194. Since the ends 332 and 334 of the orifice are concave, the end walls, indicated by the cross-sections 318, 324, 328 (and the mirror cross-sections 319, 325, 329) are also concave, so that each of the wall sections has different stepped curvature across the width of the orifice, as illustrated by wall portions 346, 347; 348, 349; and 350, 351 leading to the intersections of bulbous or convex ends 336 and 338 with orifice side 332 at points 352 and 353, as illustrated in FIG. 11. These latter wall portions 350, 351 form a different exit angle at the exit orifice, as indicated by arrows 354 and 355 which intersect at location (2), indicated at 356, also distally of the orifice 194, but closer than location (3). These stepped wall curves provide a compound curve geometry, generally indicated at 358 for fluid channel 322 and at 360 for fluid channel 323, leading to the edges, or throat of the orifice 194. The wall portions 328, 329, and 350, 351 surround the interaction region 310 distally of the stub 262 and terminate at the throat of the exit orifice. The side wall 320 (which may be referred to as a rear side wall as viewed in FIGS. 11 and 12), is spaced away from (behind, as viewed in FIGS. 11 and 12) and is generally parallel to protuberance 262, and preferably is not curved.

Since the wall portions 318, 319, 324, 325, 328 and 329 curve distally inwardly at different angles with respect to the stub 262, the distance between the wall and the stub, indicated by arrow (4), and thus the width of the fluid feed channels 322 and 323 on each side of the stub 262 (as viewed in FIGS. 11 and 12) varies at different locations from the entry to the interaction chamber 192 at wall 187 to the interaction region 310. The feed channels begin at the power nozzle channels 256 and 258 forming the lower portion of the fluidic circuit in the top of the sealing post and are effectively a continuation of these channels from the housing 196 distally into the cup 180; thus, the feed channels may also be referred to as upper portions of fluidic circuit power nozzles which direct jets of fluid under pressure into the interaction region 310. The compound curve geometry of the wall portions of the feed channels causes the power nozzle height (4) to vary continuously along the length of and around a part of the stub 262, with the shape is defined by the diameter (6) of axial protuberance 262 and the geometry of the wall portions 318, 319; 324, 325; 328, 329; 346, 347; 348, 349; and 350, 351, which portions may be referred to as the orifice lips. The compound curves 358 and 360 forming the geometry of the lips may be generally defined by the intersection angles (9) and (10), illustrated by arrows 340, 342 and 352, 354, respectively, their intersection locations (2) and (3) at points 344 and 356, respectively, and the throat heights (8) and (7) for the center and the sides, respectively, of exit orifice 194, which, in the illustrated embodiment has opposed convex lip members 336, 338 which are shaped to control distribution of the sprayed fluid.

All of these dimensions influence the trajectory and velocity profiles of the intersecting jets and of the fluid ejected from the interaction region 310 through the exit orifice 194. While the trajectory and velocity do change across the circuit width and as flow processes downstream, they are characterized by line tangents and intersection points 344 and 356 at the center and at the outer edges of the exit orifice throat 330. The throat height (7) is smallest and the lip intersection angle (10) is largest at the outer edges of the orifice throat, as illustrated at points 352 and 353. Conversely, the throat height (8) is largest and lip intersection angle (9) is smallest at the center of the orifice throat. Intersection angles tested range from 50° to 180° degrees, while the preferred embodiment illustrated has lip intersection angles (9) and (10) of approximately 110° and 120°, respectively.

The fluid flow from passageways 294 and 296, indicated by arrows 312 and 314, is diverted distally (upwardly in FIG. 11) along the axial protuberance 262, with the channels 256 and 258 and the feed channels 322 and 323 acting as fluidic circuit power nozzles to produce first and second fluid jets which are directed in opposition into the interaction region 310 to generate oscillating flow vortices within the interaction region. This region is in fluid communication with the discharge or exit orifice 194 defined in the fluidic circuit's distal wall, and the oscillating flow vortices eject spray droplets 316 through the discharge orifice as an oscillating spray of substantially uniform fluid droplets in a selected (e.g., flat fan shaped) spray pattern having a selected spray width and a selected spray thickness (not shown) along central spray axis 210. In the illustrated embodiment, the power nozzles are shown to be diametrically opposed to provide an inter-jet impingement angle of 180 degrees in the interaction region, meaning the jets impinge from opposite sides; however, it will be understood that the nozzles may be molded in the upper surface of the sealing post and in the cup 180 so that the first and second jets impinge at a selected inter-jet impingement angle of, for example from 50 to 180 degrees. The area ratio of the circuit is defined as the throat area (TA) divided by the power nozzle area (PA). As the area ratio is increased to values greater than one, the fluidic circuit will have an increased tendency to entrain air. Alternatively, area ratios less than one allow for lower flow rates without air entrainment. Increasing the area ratio or the lip intersection angles will also cause an increase in fan angle. As illustrated in FIGS. 11 and 12, the rectangular boss 200 incorporates distally and outwardly sloping faces 362, 364, 366 and 368 leading from corresponding orifice edges 332, 334, 336 and 338, respectively, to form an outlet for the exit orifice.

As noted above, the power nozzle channels 256, 258 may be fabricated into or defined as grooves or depressions within the interior surface of the cup member (e.g., 180) so that distal upper face 252 of sealing post 232 is substantially planar, except for distally projecting stub 260. The assembled components (cup member 180 sealed upon sealing post 232) together define the fluidic circuit's lumens or channels including power nozzle channels 256, 258. An alternative embodiment for a cup member component is illustrated at 380 in FIGS. 13 and 14, where a 2nd generation flag mushroom cup utilizes a throat geometry 382 that is similar (in some respects) to that illustrated in applicant's own WO2012145537, but is configured for use with a conical (not cylindrical) sealing post (not shown) to seal opposing power nozzles at a specified power nozzle intersection angle, Pa. In this embodiment angle Pa is 140 degrees. Applicants' prototype development work appears to demonstrate that a Pa reduced below 180° (as in WO2012145537) allows greater control of spray fan angle and spray distribution uniformity. This is particularly evident at lower fan angles ranging from 20-50 degrees. This alternative embodiment of the flag mushroom cup is better suited for spraying water-like fluids.

When spraying, fluid or liquid product flows through first and second power nozzles or feed channels defined between the post and cup and the flows from the first and second channels to intersect within a distally projecting interaction region defined around a distally projecting small protuberance carried on the sealing post, through a throat and an exit orifice to ambient. Throat design variations can allow for more or less air entrainment in the flowing fluid by changing the geometry of selected features including the throat/PN ratio, the exit angle, and placement of the intersection of the first and second fluid jets. The illustrated fluidic circuit configuration generates a spray of shear thinning and high viscosity fluids with even distribution. The packaging concept and method of the present invention allow easier molding of small circuits because the circuit features are defined or "shared" between two larger molded pieces rather than having all of the fluidic circuit features defined in one molded piece. The nozzle assembly housing 196 and cup member 180 differ from Applicant's prior work illustrated in FIG. 1D, in that the housing and sealing post differ, as does the fluidic circuit geometry molded into the cup member.

The flag mushroom cup nozzle assembly of the invention effectively splits the operating features of the fluidic circuit between the housing's sealing post member 232 and the cup member 180. The flag mushroom nozzle assembly is made possible by configuring the packaging and design of a flag mushroom fluidic to provide a conformal cup-shaped member 180 that is ideally well suited for use with a novel sealing post member 232, where the new combination is then adapted for integration with commercial spray nozzle assemblies which are otherwise similar to those described in the prior art and illustrated in FIGS. 1A-1F.

In an exemplary commercial product spraying embodiment, the nozzle assembly housing 196, or spray head actuator, includes a lumen or duct for dispensing a pressurized liquid product or fluid from a valve, pump or actuator assembly which draws from a disposable or transportable container (e.g., like container 26 in FIG. 1A) to generate an oscillating spray of very uniform fluid droplets. The flag mushroom cup nozzle assembly 180 is configured to spray shear thinning liquids with an even distribution of small droplets. The nozzle assembly is adapted for commercial aerosol sprays like paints, oils, and lotions, and in use generates an even flat fan spray with more uniform and smaller droplets than similar prior art nozzles can generate. The flag mushroom cup nozzle assembly of the present invention, when spraying, does not create voids or hotspots, and also allows for the use of aeration. The nozzle assembly is configured to reliably begin oscillation and then generate droplets of a selected size which are projected distally to provide a precisely defined sheet or flat fan-shaped spray when spraying relatively thick or viscous fluids, such as shear-thinning fluids like Acrylic spray paint. The nozzle assembly is also optimized to generate precise sprays of other thick or viscous liquids such as Lotion, Oil or Chemical cleaners.

Persons of skill in the art will understand that the present invention makes available a useful and novel nozzle assembly or spray head adapted for spraying viscous fluids such as paint lotion or oil in a flat fan spray from a commercial portable product package by dispensing or spraying from a valve, pump or actuator assembly to generate an exhaust flow in the form of an oscillating spray of fluid droplets by providing a combination of elements which work together to provide the benefits described above, including:

(a) an actuator body member (196) having a bore 228 forming a fluid lumen and having a sealing post (232) distally projecting into said bore, said post having a post peripheral wall (254) with a longitudinal indexing key (234) and terminating at a distal or outer face (252) incorporating an axial protuberance or stub (262) projecting distally from an intersection of first (256) and second (258) fluid channel troughs or grooves, said actuator body including a fluid passage (226) communicating with said bore;

(b) a flag mushroom cup-shaped fluidic circuit defining member (180) mounted in said actuator body member having a peripheral wall (188) extending proximally into said bore in said actuator body radially outwardly of said sealing post and having a distal radial wall (186) having an inner face (187) opposing said distal or outer face of said sealing post to define with said sealing post first and second fluid passageways (294, 296) in fluid communication by way of said first and second grooves with a chamber (192) having an interaction region (310) between said sealing post protuberance and said cup-shaped fluidic circuit's peripheral wall and distal wall;

(c) the fluid passageways being in fluid communication with said actuator body fluid passage to define a fluidic circuit oscillator inlet so said pressurized fluid may enter said interaction region;

(d) the cup-shaped fluidic circuit distal wall's inner face being configured to cooperate with said sealing post's first and second fluid channel troughs or grooves to define within said chamber a first power nozzle and second power nozzle, wherein said first power nozzle is configured to accelerate the movement of passing pressurized fluid flowing through said first nozzle to form a first jet of fluid flowing into said chamber's interaction region, and said second power nozzle is configured to accelerate the movement of passing pressurized fluid flowing through said second nozzle to form a second jet of fluid flowing into said chamber's interaction region, and wherein said first and second jets impinge upon one another at an angle of between 50 and 180 degrees and upon said sealing post's axial protuberance at a selected inter-jet impingement angle to generate oscillating flow vortices within said fluid channel's interaction region;

(e) wherein the chamber's interaction region is in fluid communication with a discharge orifice or exit orifice (194) defined in said fluidic circuit's distal wall (188) preferably with opposed convex lips 336, 338 for controlling distribution of the sprayed fluid, and where the oscillating flow vortices exhaust from said discharge orifice as an oscillating spray (316) of substantially uniform fluid droplets in a selected spray pattern having a selected spray width and a selected spray thickness, and (f) wherein that flag mushroom cup-shaped fluidic circuit's distal end wall's exit orifice is defined between first and second distally projecting sidewalls (202, 204) defining a distally projecting snout (200).

In addition, the nozzle fluid circuit assembly (300) optionally includes first and second power nozzles which terminate in a rectangular or box-shaped interaction region (190)

defined in the cup-shaped member's distal wall's inner face. The flag mushroom cup assembly (e.g., 300) effectively splits the operating features of the fluidic circuit between a lower or proximal portion formed in the housing's sealing post member and an upper, or distal portion formed in cup member 180 which, in cooperation with the sealing post's distal surface, defines the interaction chamber which is exhausted via the one-piece cup member's discharge orifice 194. So an alignable conformal, cup-shaped flag-mushroom fluidic nozzle assembly is provided to generate a flat fan or sheet oscillating spray of viscous fluid product 316. The nozzle assembly of the present invention includes an improved, specially adapted cylindrical flag mushroom fluidic cup member 180 provides or defines the operating features of the fluidic circuit not included in the lower or proximal portion formed in the housing's sealing post member to provide an upper, or distal portion formed within cup member 180 which, in cooperation with the sealing post's distal surface, defines interaction chamber 192, which is fed by first and second impinging jets each comprising a continuous distribution of streamlines that impinge at selected angles to define arcs providing a lesser degree of impingement at a centered axial plane within the exit orifice 194 and a greater degree of impingement at the edges of exit orifice 194.

Having described preferred embodiments of a new and improved spray nozzle assembly and method, it is believed that other modifications, variations and changes will be suggested to those skilled in the art in view of the teachings set forth herein. It is therefore to be understood that all such variations, modifications and changes are believed to fall within the scope of the present invention as set forth in the appended claims.

What is claimed is:

1. A two-part fluid nozzle assembly for generating an oscillating spray, comprising:

(a) a housing having a distal bore surrounding a sealing post having a distal end;

(b) lower components of a fluidic circuit formed in the housing including radial channels formed in the sealing post and directed at a distally extending stub on said distal end;

(c) a cup-shaped member mounted in said bore surrounding said post and incorporating a distal end wall on the cup-shaped member, said distal end wall having an inner surface engaging at least a part of said distal end of the housing;

(d) said cup-shaped member incorporating an inner side wall configured to cooperate with said post to form fluid flow passageways leading to said lower components;

(e) upper components of said fluidic circuit formed in the distal end wall of the cup-shaped member, said upper components including:

an interaction chamber having walls incorporating compound curves cooperating with said post and said stub to form feed channels leading to an interaction region; and an exit orifice in the cup-shaped member at a distal end of said interaction region;

(f) whereby pressurized fluid supplied to said housing bore flows through said lower components and said upper components to create a fluid vortex in said interactive region to cause fluid to be ejected from said interaction region through said exit orifice to produce an oscillating spray.

2. The two-part fluid nozzle assembly of claim 1, wherein said exit orifice has convex ends wherein compound curves of said walls terminate at the convex ends.

3. The two-part fluid nozzle assembly of claim 2, wherein said compound curves cooperate with the stub to produce varying feed channel lumen configurations to generate or produce fluid flow vortices in selected flowing fluid products and generate selected vortex characteristics.

4. The two-part fluid nozzle assembly of claim 3, wherein the heights of the feed channel lumens are varied to generated or produce fluid flow vortices.

5. The two-part fluid nozzle assembly of claim 1, wherein said upper and lower components have complementary geometry to produce unitary fluidic circuit when assembled.

6. The two-part fluid nozzle assembly of claim 3, wherein said radial channels are completely blocked by said stub to redirect fluid flow distally through said feed channels to said interaction region.

7. The two-part fluid nozzle assembly of claim 1, wherein the radial channels define first and second power nozzles configured to generate first and second fluid jets which, respectively, exit the first and second power nozzles and conform to concave curved walls or curved surfaces on the upper component;

wherein the first and second jets impinge within the interaction region with a lesser degree of impingement created along a centered axial plane within the exit orifice in comparison to impingement at edges of the exit orifice, thereby creating a distally projecting spray product.

8. The two-part fluid nozzle assembly of claim 1, wherein the interaction region defined in said cup-shaped fluidic circuit distal wall inner face has a rectangular or boxed shape.

9. The two-part fluid nozzle assembly of claim 1, wherein said discharge orifice has opposed convex lips for controlling distribution of the sprayed fluid.

10. The two-part fluid nozzle assembly of claim 1, further comprising a longitudinal indexing key on said distally end of said post configured to be receive within an indexing slot.

11. The two-part fluid nozzle assembly of claim 1, wherein said two-part fluid nozzle assembly is configured with a hand operated pump in a trigger sprayer configuration.

12. The two-part fluid nozzle assembly of claim 1, wherein said two-part fluid nozzle assembly is configured with propellant pressurized aerosol container with a valve actuator.

* * * * *